US008063307B2

(12) United States Patent
Bukshpun et al.

(10) Patent No.: US 8,063,307 B2
(45) Date of Patent: Nov. 22, 2011

(54) SELF-HEALING ELECTRICAL COMMUNICATION PATHS

(75) Inventors: Leonid Bukshpun, Encino, CA (US); Ranjit Pradhan, Torrance, CA (US); Kang S. Lee, Woodland Hills, CA (US); Thomas Forrester, Hacienda Heights, CA (US); Tomasz Jannson, Torrance, CA (US)

(73) Assignee: Physical Optics Corporation, Torrance, CA (US)

( * ) Notice: Subject to any disclaimer, the term of this patent is extended or adjusted under 35 U.S.C. 154(b) by 59 days.

(21) Appl. No.: 12/272,616

(22) Filed: Nov. 17, 2008

(65) Prior Publication Data

US 2010/0122832 A1 May 20, 2010

(51) Int. Cl.
*H01B 3/30* (2006.01)

(52) U.S. Cl. ..... 174/102 SC; 174/117 F

(58) Field of Classification Search ..... 174/102 SC, 174/120 SC, 117 F

See application file for complete search history.

(56) References Cited

U.S. PATENT DOCUMENTS

| | | | |
|---|---|---|---|
| 2,021,111 | A | 11/1935 | Wheat |
| 2,824,290 | A | 2/1958 | Archer et al. |
| 3,521,216 | A | 6/1968 | Tolegian |
| 3,555,695 | A | 1/1971 | Dunn |
| 3,790,858 | A | 2/1974 | Brancaleone |
| 4,034,172 | A | 7/1977 | Glover et al. |
| 4,087,297 | A | 5/1978 | Johnson |
| 4,308,572 | A | 12/1981 | Davidson |
| 4,480,293 | A | 10/1984 | Wells |
| 4,570,206 | A | 2/1986 | Deutsch |
| 4,602,191 | A | 7/1986 | Davila |
| 4,728,751 | A | 3/1988 | Canestaro |
| 4,752,351 | A | 6/1988 | Lunt |
| 4,774,434 | A | 9/1988 | Bennion |
| 4,785,136 | A | 11/1988 | Mollet |
| 4,885,570 | A | 12/1989 | Chien |

(Continued)

FOREIGN PATENT DOCUMENTS

| | | |
|---|---|---|
| WO | 9820505 | 5/1998 |

(Continued)

OTHER PUBLICATIONS

Jannson, T.P., Kostrzewski, A.A., Lee, K.S., Hester, T.J., Forrester, T.C., Savant, G.D., "Soft Computing and Small System Integration." Applications of Digital Image Processing XXVII, Aug. 2-6, 2004, Denver, CO.

(Continued)

*Primary Examiner* — Chau Nguyen

(74) *Attorney, Agent, or Firm* — Sheppard Mullin Richter & Hampton LLP

(57) ABSTRACT

Self-healing electrical garments and self-healing electrical conductors and components for use in electrical garments are provided. A communication medium of various forms is integrated into a garment seam that is used to join two or more portions of a garment. The communication media can be used to provide electrical or other electromagnetic connection for coupling among a plurality of electrical devices associated with the garment. The self-healing electrical conductor may be used as part of a garment portion or may be used as a joining fiber in a variety of techniques to join garment portions together. The self-healing electrical conductor comprises an electrical conductor, a conductive polymer immediately surrounding or adjacent to the electrical conductor, an insulator enclosing the electrical conductor and the conductive polymer.

33 Claims, 21 Drawing Sheets

U.S. PATENT DOCUMENTS

| | | | | |
|---|---|---|---|---|
| 4,950,171 | A | 8/1990 | Muzslay | |
| 4,975,317 | A | 12/1990 | Kuhn | |
| 5,145,408 | A | 9/1992 | Houtteman | |
| 5,290,191 | A | 3/1994 | Foreman | |
| 5,375,044 | A | 12/1994 | Guritz | |
| 5,455,749 | A | 10/1995 | Ferber | |
| 5,497,140 | A | 3/1996 | Tuttle | |
| 5,551,882 | A | 9/1996 | Whiteman | |
| 5,586,668 | A | 12/1996 | Miller | |
| 5,624,736 | A | 4/1997 | DeAngelis et al. | |
| 5,646,592 | A | 7/1997 | Tuttle | |
| 5,656,990 | A | 8/1997 | Schwimmer | |
| 5,704,792 | A | 1/1998 | Sobhani | |
| 5,785,181 | A | 7/1998 | Quartararo | |
| 5,906,004 | A | 5/1999 | Libby | |
| 5,973,598 | A | 10/1999 | Beigel | |
| 5,986,562 | A | 11/1999 | Nikolich | |
| 6,013,346 | A | 1/2000 | Lewis | |
| 6,080,690 | A | 6/2000 | Lebby | |
| 6,243,870 | B1 | 6/2001 | Graber | |
| 6,254,403 | B1 | 7/2001 | Bernardini | |
| 6,261,360 | B1 | 7/2001 | Dry | |
| 6,324,053 | B1 | 11/2001 | Kamijo | |
| 6,350,129 | B1 | 2/2002 | Gorlick | |
| 6,381,482 | B1 | 4/2002 | Jayaraman | |
| 6,412,701 | B1 | 7/2002 | Kohama | |
| 6,420,008 | B1 | 7/2002 | Lewis | |
| 6,455,769 | B1 * | 9/2002 | Belli et al. | 174/23 C |
| 6,518,330 | B2 | 2/2003 | White | |
| 6,573,456 | B2 | 6/2003 | Spruell | |
| 6,727,197 | B1 | 4/2004 | Wilson | |
| 6,729,025 | B2 | 5/2004 | Farrell | |
| 6,767,218 | B2 | 7/2004 | Marmaropoulos | |
| 6,805,568 | B2 | 10/2004 | Ruzmenka | |
| 6,895,261 | B1 | 5/2005 | Palamides | |
| 6,939,142 | B2 | 9/2005 | Maruyama | |
| 6,957,345 | B2 | 10/2005 | Cesana | |
| 7,094,084 | B2 | 8/2006 | Lee | |
| 7,151,455 | B2 | 12/2006 | Lindsay | |
| 7,297,002 | B2 | 11/2007 | Kostrzewski | |
| 7,302,145 | B2 | 11/2007 | Huston | |
| 7,335,067 | B2 | 2/2008 | Lee | |
| 7,344,379 | B2 | 3/2008 | Marmaropoulos | |
| 7,462,035 | B2 | 12/2008 | Lee | |
| 2001/0056542 | A1 | 12/2001 | Cesana | |
| 2003/0040247 | A1 | 2/2003 | Rehkemper | |
| 2004/0007784 | A1 * | 1/2004 | Skipor et al. | 257/788 |
| 2004/0133088 | A1 | 7/2004 | Al-Ali | |
| 2005/0012619 | A1 | 1/2005 | Sato | |
| 2005/0136257 | A1 | 6/2005 | Easter | |
| 2005/0242297 | A1 | 11/2005 | Walker | |
| 2005/0242950 | A1 | 11/2005 | Lindsay | |
| 2005/0253708 | A1 | 11/2005 | Bohman | |
| 2006/0125642 | A1 | 6/2006 | Chandaria | |
| 2006/0128169 | A1 | 6/2006 | Marmaropoulos | |
| 2006/0172719 | A1 | 8/2006 | Chen | |
| 2006/0193569 | A1 * | 8/2006 | Huston et al. | 385/100 |
| 2006/0214789 | A1 | 9/2006 | Posamentier | |
| 2007/0015404 | A1 | 1/2007 | Shisler | |
| 2007/0026695 | A1 | 2/2007 | Lee | |
| 2007/0026696 | A1 | 2/2007 | Kostrzewski | |

FOREIGN PATENT DOCUMENTS

| | | |
|---|---|---|
| WO | 0136728 | 5/2001 |
| WO | 2005013738 | 2/2005 |
| WO | 2007015786 | 2/2007 |
| WO | 2007032816 | 3/2007 |

OTHER PUBLICATIONS

Kostrzewski, A.A., Lee, K.S., Gans, E., Winterhalter, C.A., Jannson, T.P., "Innovative Wearable Snap Connector Technology for Improved Networking in Electric Garments," Sensors, and Command, Control, Communications, and Intelligence (C31) Technologies for Homeland Security and Homeland Defense VI, Apr. 9-12, 2007, Orlando, FL.

Farringdon, Jonny, Moore, Andrew J., Tilbury, Nancy, Church, James, Biemond, Peter D., "Wearable Sensor Badge and Sensor Jacket for Context Awareness," IEEE, 1999, pp. 107-121.

Post, E. Rehmi, Orth, Maggie, "Smart Fabric, or Washable Computing," IEEE, Oct. 13-14, 1997, pp. 167-168, Cambridge, MA.

Post, E.R., Orth, M., Russo, P.R., Gersherfeld, N., "E-broidery: Design and Fabrication of Textile-Based Computing," IBM Systems Journal, 2000, vol. 39 No. 354, pp. 840-860.

Post, Rehmi E., Reynolds, Matt, Gray, Matthew, Paradiso, Joe, Gershenfeld, "Intrabody Buses for Data and Power", IEEE, 1997, pp. 52-55.

* cited by examiner

Illustration of a self-healing interconnect between wearable connectors and conducting physical layer.

SELF-HEALING ELECTRICAL COMMUNICATION PATHS

TECHNICAL FIELD

The present invention relates to electromagnetic communications, and more particularly, some embodiments relate to self-healing wires and other electrical/electromagnetic conduction paths, intelligent rerouting through redundant communication paths, and electrical garments and other articles making use of the same.

DESCRIPTION OF THE RELATED ART

Electronic devices have become a ubiquitous and pervasive part of our contemporary milieu. This phenomenon has been catalyzed by advances in electronics and battery technologies, which have led to the viability of lower power, feature rich, compact and lightweight portable electronic devices. For example, cellular telephones, PDAs, digital media players and portable gaming apparatuses, to name a few, are not only commonplace, but have become de rigueur accessories of our contemporary lifestyles. This phenomenon is not only readily observable in our day-to-day lives, but is further evidenced by the many commercial efforts to better integrate such electronic devices into our clothing and other accessories.

The uses of portable electronic devices are not confined to casual or recreational uses such as is often the case with media players and gaming apparatuses. In fact, portable electronic devices are a common and indeed necessary accouterment in many commercial and professional settings and also enjoy widespread uses in various military and medical applications. For example, in medical applications, the use of monitoring devices or other sensors for telemetry monitoring of a patient's health, vital signs or other symptoms has become commonplace. As another example, military personnel are increasingly becoming more "wired" as they are outfitted with not only communication devices but also computers or computing systems, GPS receivers, head mounted displays (HMD) and other electronic accessories. Because attaching these devices directly to the body can be uncomfortable or impractical, and because it is not always possible or practical to carry these devices with one's hands, it has become increasingly desirable to allow these electronic devices to be fitted to the wearer's garments. Because it may be desirable for a plurality of electronic devices carried by a user to communicate with one another, or to be connected to a separately housed power supply, electrical interconnects have become an increasing consideration for these devices.

For example, U.S. Pat. No. 6,324,053 is a patent directed toward a wearable data processing system and apparel, that purportedly provides a system and method for electrical interconnection of devices included in a wearable computer, so that a light cable network can be deployed that does not limit the body movements of the human being. As another example, U.S. Pat. No. 6,381,482 is directed toward a fabric or garment with integrated flexible information infrastructure that purportedly includes a fabric in the form of a woven or needed garment that includes a flexible information infrastructure integrated with in the fabric for collecting, processing, transmitting and receiving information.

Other technologies that are somewhat related include technologies for providing electrically conductive textile materials. For example, U.S. Pat. No. 4,975,317 is a patent directed toward electrically conductive textile materials and method for making the same. According to this patent, fabrics are made of electrically conductive by covering the fibers of the fabric with an ordered conductive film. As another example, U.S. Pat. No. 6,080,690 is directed toward a textile fabric with an integrated sensing device and clothing fabricated thereof. This patent is purportedly directed toward a textile fabric that includes a plurality of electrically conductive fibers and at least one electronic sensor, or a plurality of sensing fibers.

As yet another example, U.S. Pat. No. 6,727,197, titled "Wearable Transmission Device" is purportedly directed toward a knitted, woven, or braided textile ribbon that includes fibers and one or more transmission elements running the length of the ribbon in the place of the one or more fibers. Unfortunately, depending on the materials chosen and the application, the replacement of one or more fabric fibers with electrical conductors, can result in adverse effects such as a weakening of the strength of the garment or an increase in weight of the garment or might adversely affect the hand or feel of the garment.

Self-healing techniques have been used for mechanical structures, because cracks that form in materials such as structural metals, for example, can be difficult to detect without rigorous, time-consuming inspections. When found, cracks in such materials can be difficult if not impossible to repair. One method for self-healing of cracks in materials is described in U.S. Pat. No. 6,518,330. This self-healing system includes a composite material containing microcapsules and catalysts. The microcapsules include a healing agent that, when coming in contact with the catalyst, is polymerized. Accordingly, if a crack forms in the material, the crack fractures one or more microcapsules causing a release of the healing agent, which then comes into contact with the catalyst thereby curing the polymer and sealing the crack.

Another application of self-healing materials can be found in U.S. Pat. No. 6,261,360, which appears to be directed toward a self-repairing, fiber reinforced matrix material that includes inorganic as well as organic matrices. Disposed within the matrix are hollow fibers having a selectively releasable modifying agent contained therein. The hollow fibers may be inorganic or organic and of any desired length, wall thickness or cross-sectional configuration. The modifying agent is selected from materials capable of modifying the matrix fiber composite after curing. The modifying agents are selectively released into the surrounding matrix in use in response to a predetermined stimulus be it internal or externally applied. The hollow fibers may be closed off or even coated to provide a way to keep the modifying agent in the fibers until the appropriate time for selective release occurs. Self-repair, smart fiber matrix composite materials capable of repairing microcracks, releasing corrosion inhibitors or permeability modifiers are described as preferred embodiments in concrete and polymer based shaped articles.

Other self-healing techniques have also been employed in wire and cable applications. Conventional technologies for self-healing cabling have focused on techniques for surrounding conductive elements with adaptive or sealable insulating covers that provide some level of damage resistance and self-sealing of the insulation when cuts or punctures are sustained. Examples of such conventional technologies can be found in U.S. Pat. Nos. 7,302,145 and 6,573,456 as well as patent publication number 05/136,257. Such technologies appear to be directed toward self-sealing insulators to ensure that the metallic conductor is not exposed to harsh environments if the insulation is damaged.

Today's wearable networks, including those being researched, fall short of fulfilling needs for redundancy and reliability as well as comfort and mobility. This is because conventional technologies are not conducive to the creation of robust wearable networks that can autonomously recover from localized damage. At present, the technology to connect several wearable devices is based on cumbersome and heavy concealed wiring. Metallic fibers intertwined in E-textile fibers are being researched, as are conductive coatings and conductive inks. Wearable technologies such as computing silicon chips incorporated into fibers, wearable sensor systems to monitor body conditions, keyboard and flexible electronic boards based on woven metallics and flexible displays based on woven optical fibers have been demonstrated. However, present wearable systems will fail when subjected to damaging events, including impacts and cuts from projectiles and other objects.

BRIEF SUMMARY OF EMBODIMENTS OF THE INVENTION

Embodiments of the present invention are directed toward an entirely new self-healing, textile-based network that can be autonomously self-healing and integrated into a wearable garment. In some embodiments, the system can be configured to impart biomimetic self-healing capability to the wearable network. One example of how this is accomplished is by providing a self-healing physical layer, body-conformable wearable connector elements, and redundant power and data networks.

The self-healing physical layer can be made using conductive inks, conductive carbon nanotube compositions or other conductive polymeric or elastomeric compositions. The self-healing physical layer can utilize conductive polymer based "wires" fabricated on flexible substrates and integrated into clothing through weaving or sewing that impart biomimetic capabilities that mimic or are similar to the healing process of biological systems. In various embodiments, a stimulus (bullet impact, stab, etc.) that causes a break in the conductive path simultaneously stimulates the localized release of self-healing agents that largely restore the conductive path. This concept of self-healing can be extended to other application such as, for example, self-healing optical waveguides integrated into textiles.

Blind operable rotationally symmetric connectors can connect to the physical layer such as such as, for example, those described in United States patent application publication number 2007/0105404, to Lee et al., assigned to the Physical Optics Corporation. These and other connectors can be connected to the physical layer by a self-healing interconnection based on conductive gels. The use of separate, redundant power and data networks with smart network architectures can be included to provide multi-path redundancy that complements the self-healing feature of the communication paths. The physical layer can be integrated into clothing instead of on the surface, providing additional safeguards against damage from external sources.

With systems and methods described herein, wearable networks, computing systems and other electrical garments and assemblies can be used in a variety of applications, including military and commercial applications, as well as wearable articles for firefighters, police, and other first responders. Similar wearable networks will find applications in medicine, fitness monitoring, space applications and other environments as well.

According to various embodiments of the invention, self-healing conductors and articles fabricated including self-healing conductors can be provided. For example, articles made using self-healing conductors can include fabrics, materials, garments, or other like articles just to name a few. However, as would be apparent to one of ordinary skill in the art after reading this document, there are potentially numerous applications for self-healing conductors of the type described herein.

In various embodiments of the invention, a flowable conductive polymer is provided in close proximity to an electrical conductor in a self-healing conductor. Upon damage to the self-healing conductor, the container or other structure containing the flowable conductive polymer is also ruptured allowing the conductive polymer to flow to the area of damage sustained by the electrical conductor. Preferably, the flowable conductive polymer is able to cure such that it remains in place in the area of damage sustained by the electrical connector thereby facilitating electrical conductivity of the electrical connector.

In an embodiment a self-healing conductor is provided. The self-healing conductor includes an electrical conductor and a conductive polymer immediately surrounding the electrical conductor, with an insulator enclosing both the electrical conductor and the conductive polymer.

In some embodiments, the conductive polymer is suited to the use of curing agents that, when mixed with the conductive polymer, cause it to commence curing. Preferably, the conductive polymer is cured to the extent that it ceases to flow at operating temperatures thereby allowing the conductive polymer to remain in place in the area of damage sustained by the electrical conductor. Such curing agents can also be contained in containers or other containment mechanisms adjacent to or nearby the electrical conductor such that when damage is sustained to the electrical conductor, curing agents are freed from their container and allowed to mix with the conductive polymer. In other embodiments, self-curing or air-curable polymers can be utilized such that curing agents are not necessary.

Yet another embodiment provides a self-healing electrical conductor. The self-healing electrical conductor includes an electrical conductor with a conductive polymer layer immediately surrounding the electrical conductor. The conductive polymer is in turn surrounded by a curing agent. An insulator encloses the electrical conductor and the curing agent.

Conductive polymers and curing agents can be selected with viscosities and cure times as may be desired for a given application. For example, it may be desirable to allow a low enough viscosity and a short enough time to allow the liquid polymer to reach the area of damage in the electrical conductor, while limiting the cure time or keeping the viscosity high enough such that the conductive polymer does not flow from the area excessively. For example, it may be desirable to limit the flow such that the conductive polymer does not result in shorting with other conductors. It may also be desirable to limit the flow of the conductive polymer such that sufficient polymer remains in other areas of the self-healing conductor to allow similar repairs to other damaged areas. Likewise, for the comfort and appearance of the articles in which the self-healing conductors might be utilized it may also be desirable to limit the amount of flow of the conductive polymer and curing agents.

A still further embodiment provides an electrical garment using self-healing electrical conductors in the garment construction. The electrical garment consists of at least one garment portion. The self-healing conductor is used to join at least one garment portion.

Another embodiment of an electrical garment provides at least one garment portion with the garment portion incorporating self-healing conductors. The self-healing conductors are formed into redundant communication paths configured as parallel communication paths between at least two nodes on the garment portion. Fusable links to connect a selected one or more of the redundant communication paths are provided to maintain electrical functionality in the event of damage to a portion of the garment.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

DETAILED DESCRIPTION OF THE EMBODIMENTS OF THE INVENTION

The present invention is directed toward self-healing conductors and articles manufactured using or including the same.

Figure 1:
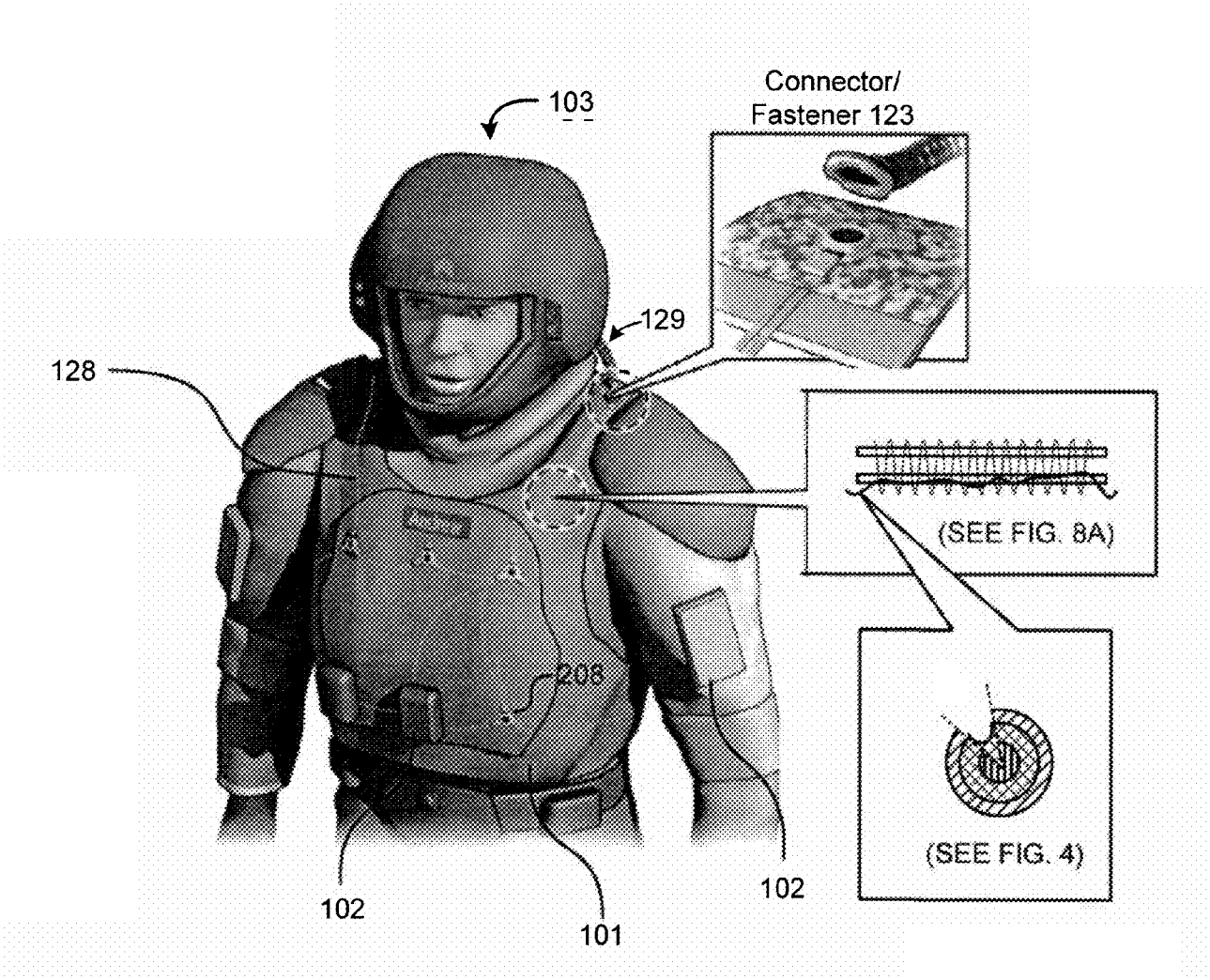
FIG. 1 is a diagram illustrating the first example of military garment(s) with which the technologies described herein can be implemented.

Before describing the invention in full detail, it is useful to describe a few example environments with which the invention can be implemented. One such example is that of a military garment or garment set such as for example, a military vest, shell, pack our pouch. Another example is a medical garment for use within our outside of a hospital, hospice or other treatment facility. Other examples can include photographer's vests, other special-purpose clothing or other formal, business or casual attire. FIG. 1 is a diagram illustrating the first example of a military garment with which the technologies described herein can be implemented. Referring now to FIG. 1, the illustrated example environment includes a plurality of military garments including a military vest 101, smart pouches 102 and a helmet 103. One or more wearable connectors 123 can also be provided to allow electrical connectivity between the garment and other articles. The connectors can provide mechanical as well as electrical connectivity. Although not illustrated, these garments can include one or more electrical devices such as, for example, a helmet mounted display, a flexible solar panel and other electrical and electronic devices.

Although not depicted in FIG. 1, the garment can include additional electrical or electronic devices such as, for example, portable computing devices, radios or other communication equipment, GPS or other positioning systems, sensors, scanners, emergency beacons, or any of a variety of other electronic devices. These electronic devices can be fixedly or removably integrated with the garment. For example, these devices might be mounted to the garment in detachable fashion such as, for example, through the use of hook-and-loop fasteners, snap fasteners or other releasable physical connections. As another example, these devices might be disposed in a pouch or other pocket of the garment such as smart pouches 102. As yet a further example, these devices might be sewn into the garment. In one embodiment, smart pouches 102 can be removably connected to the garment by way of wearable connectors that can provide electrical connectivity as well as mechanical fastenability in an integrated package.

In this and other environments, it may be desirable to provide for electrical or other electromagnetic interconnections between or among the electronic devices associated with the one or more electrical garments. Accordingly, wired or wireless communication interfaces may be provided so that the devices can communicate with one another. Additionally, electrical interfaces can be provided for provisioning power to the one or more electrical devices. In the example illustrated in FIG. 1, electrical interconnections 128 129 are illustrated as being integrated with or into textile seams in the wearable vest 101 or sewn into the vest. In this example, the electrical connections 128 129 (also referred to as communications media or electromagnetic conductors) might include a communications interface, power supply lines or other wires. Communications interlaces might be fiber optic cabling, coaxial or triaxial cabling, twisted pair, ribbon cable, or other electrical or electromagnetic medium. Such communication media might be external wiring or cabling such as communication media 129, or it could be integrated into the garment or in garment seams such as communication media 128. Examples of communication media 128 illustrated in FIG. 1 are those shown in FIGS. 5 and 8A, although other communication media can be used.

As would be apparent to one of ordinary skill in the art after reading this description, various forms of electrical, electronic or other electromagnetic communication interfaces can be provided. Accordingly, wired integrated textile seams can be provided with one or more electrical garments to provide interconnections among the various electronic devices.

From time-to-time, the present invention is described herein in terms of these example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

The present disclosure is directed toward systems, methods and apparatus related to electrical conductors and to garments and other articles manufactured using or including self-healing electrical conductors. Certain embodiments are directed toward systems, methods, and apparatuses for self-healing electrical conductors. Other embodiments are directed toward systems, methods, and apparatuses for the interconnection of electrical devices using self-healing conductors. While still other embodiments are directed toward systems, methods, and apparatuses for integrating self-healing conductors with articles such as, for example, an electrical garment. For example, some embodiments, self-healing electrical or electromagnetic communications media can be integrated into a garment or other article to allow devices associated with that garment or article to be connected thereto.

In one embodiment, a self-healing conductor is configured as a fiber or filament-like article that can be integrated into a garment or other article by means such as, for example, stitching or sewing the conductor into the article. A plurality of conductors can be integrated into the article to provide a desired network of conductive paths throughout the garment or article. In some embodiments, the self-healing conductor can be used in place of the thread or other filaments that would normally be used to sew together a garment portions. In other embodiments, additional runs of self-healing conductor can be integrated into the article or garment in addition to or instead of as normal stitching. In still further embodiments, self-healing conductors can be integrated into the seams of garments. Additionally, self-healing conductors can be applied as external wiring or links for a garment. In various embodiments, non-destructive stitching can be used so as to enable self-healing conductors to be integrated into the article or garment, without materially weakening the article. In other embodiments, self-healing conductors can be sewn into the article in various patterns to create a desired electrical effect. For example, self-healing conductors can be sewn in patterns to create RFI/EMI shields, antennas, resistive heating elements and so on.

Figure 2A:
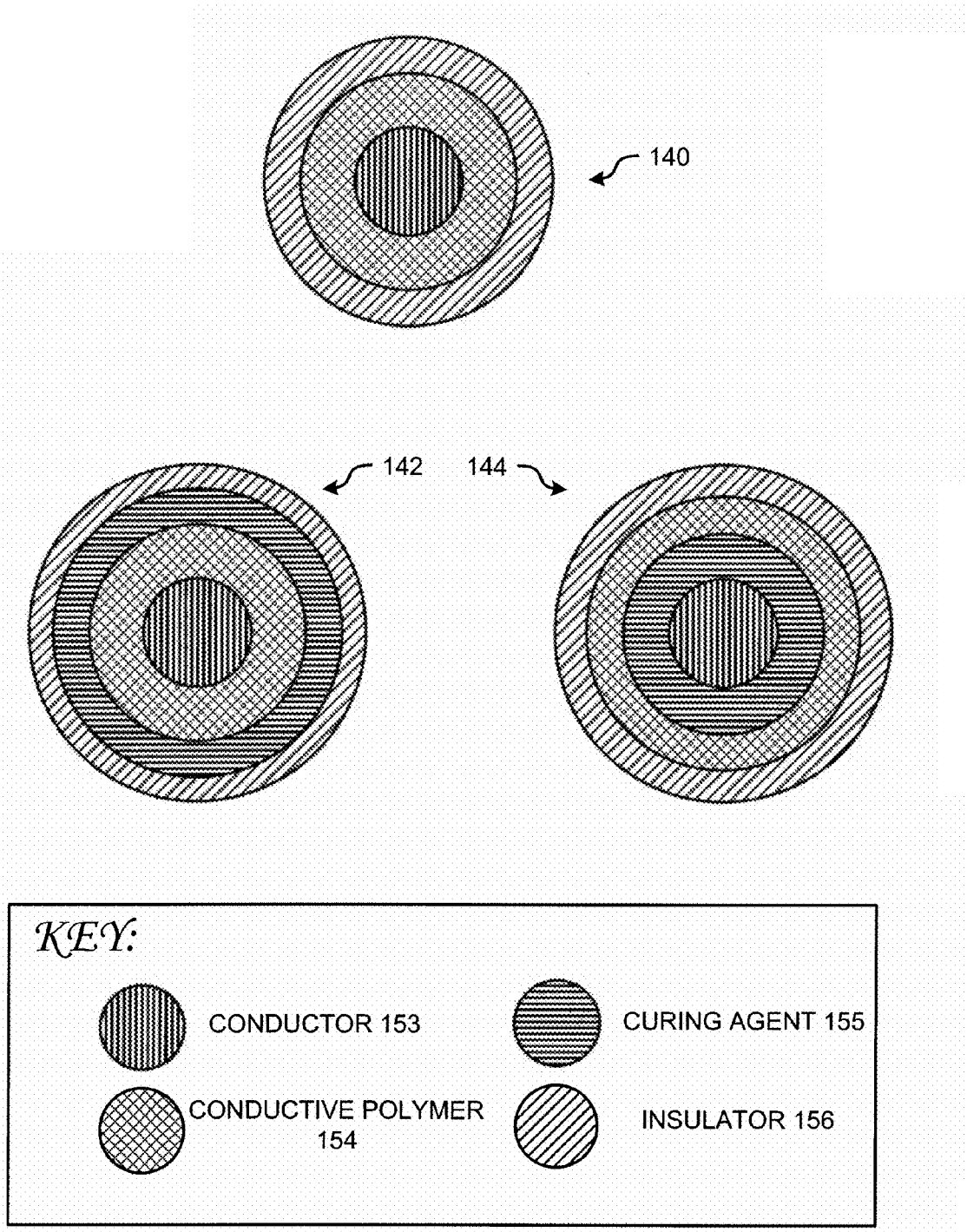
FIG. 2A is a diagram illustrating a few example configurations for a self-healing conductor using a central conductor portion in accordance with one embodiment of the invention.

There are a number of configurations that can be utilized to realize a self-healing conductor. Before describing materials and compositions that can be used for such self-healing conductors, exemplary configurations are described. FIG. 2A is a diagram illustrating a few example configurations for a self-healing conductor using a central conductor portion. Referring now to FIG. 2A, the illustrated example depicts three exemplary configurations having a central conductor portion surrounded by self-healing materials and also including an insulating material. The example illustrated at 140 shows a basic configuration having a central conducting element 153 that is immediately surrounded by a conductive polymer 154. The central conducting element 153 and conductive polymer 154 are enclosed by an insulating ring 156. In this and other embodiments, the central conducting element 153 can be comprised of copper, silver, gold, or other conducting or semi-conducting metals, elements or materials. In one embodiment, the conductive polymer in this and other examples can be comprised of a mixture of carbon nanoparticles and a bonder. Preferably, an air-curable, low viscosity bonder is used to allow flow before curing. One example uses a mixture of 1% by wt of carbon nanoparticles (SWeNT) with low viscosity bonder IB-5. IB-5 is a Cyanoacrylate Adhesive that is curable at room temperature, and is available from the SAF-T-LOK International Corporation. The mixing of the carbon nanoparticles and the bonder can be carried out in numerous ways. In one example, the mixing can be done over a period of 5 hours in an ultrasonic bath. Although not illustrated in FIG. 2A, two or more concentric layers of conductive polymer 154 can be provided.

The example illustrated at 142 is similar to that illustrated at 140, in that it includes a polymeric compositions 154 surrounding a central conductor 153. However, the example illustrated at 142 further includes a curing agent 155 surrounding polymeric compositions 154. Thus, in this embodiment, curing agent 155 is used to promote curing of the conductive polymer 154. Similarly, the example shown at 144 includes a curing agent 155 surrounding a central conductor 153. In this example, the polymer 154 is posed in a manner surrounding the curing agent 155. In both examples 142 and 144, a cut or puncture through insulator 156, curing agent 155 and polymer 154 to central conductor 153 would result in a mixing of curing agent 155 with polymer 154 allowing the polymer to flow into the damaged area of central conductor 153 and also allowing the curing agent 155 to mix with the conductive polymer 154 to result in curing.

In one example, conductive polymer 154 can be implemented using a conductive epoxy that is cured by hardener 155. One example uses a silver conductive epoxy (such as those available from MG Chemicals) as the conductive polymer 154, and Pacer Technology Slo Zap cyanoarcylate fast or instant glue as the curing agent 155.

Figure 2B:
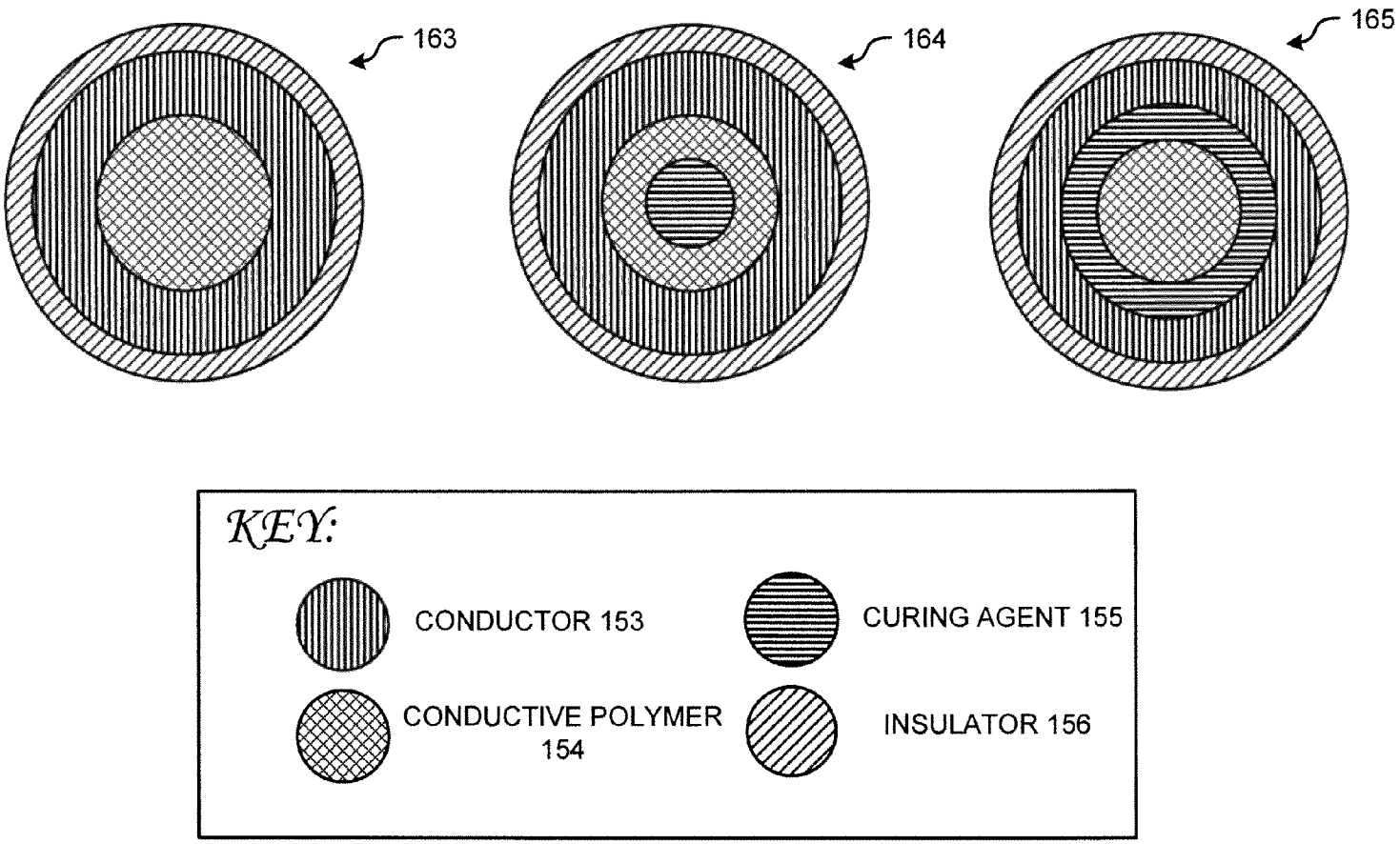
FIG. 2B is a diagram illustrating a few example configurations for a self-healing conductor using a ring conductor in accordance with one embodiment of the invention.
Figure 2C:
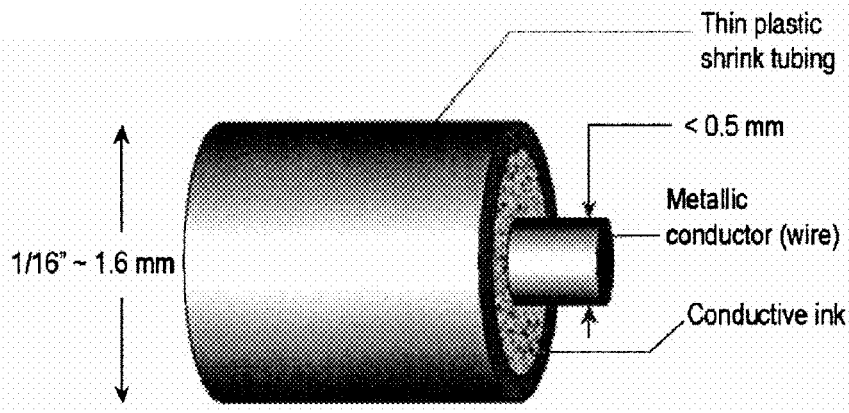
FIG. 2C is a diagram illustrating a perspective view of an example of a self-healing conductor in accordance with one embodiment of the invention.
Figure 2C:
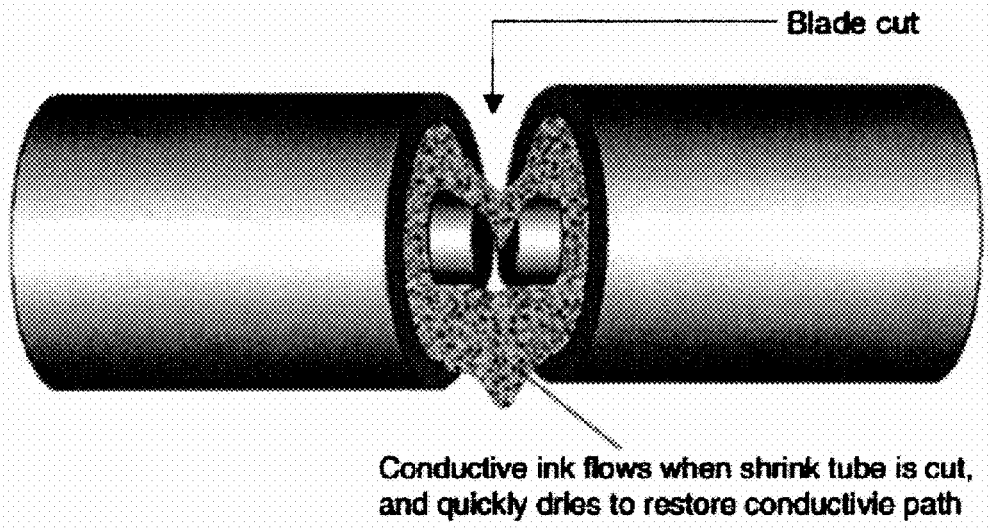

FIG. 2B is a diagram illustrating an example of a self-healing conductor that utilizes a ring conductor in accordance with several embodiments. Referring now to FIG. 2C, in the example illustrated at 163 includes a conductor 153 that is in a ring-shaped configuration. Such conductor configurations might be useful, for example, for higher frequency applications. In the example illustrated at 163, the conductive polymer is disposed in the center of ring conductor 153. Accordingly, if ring conductor 153 is cut or punctured to a depth that reaches conductive polymer 154, conductive polymer 154 can flow into the cut area, thereby filling any void in ring conductor 153. In the embodiment illustrated at 163, an air-curable polymer can be used such that conductive polymer 154 cures upon contact with the air.

The examples illustrated at 164 and 165 are examples that use a conductive polymer 154 that is cured through the use of a curing agent 155. Preferably, curing agent 155 is disposed adjacent conductive polymer 154. In the example illustrated at 164, curing agent 155 surrounds conductive polymer 154 such that when the structure is cut or punctured, curing agent 155 mixes with conductive polymer 154 in the destructive region, causing polymer 154 to cure as it flows to fill the damaged portion of conductor 153. In the example illustrated at 165, the process is similar to that in the example illustrated at 164, however, in the example illustrated at 165 the curing agent 155 surrounds polymer 154.

FIG. 2C is a diagram illustrating a perspective view of an example of a self-healing conductor in accordance with one embodiment of the invention. This figure illustrates a central metallic conductor or wire 153 surrounded by a conductive polymer 154 or conductive ink gel. In this embodiment, conductive polymer 154 is air curable, as there is no curing agent. The structure is contained by a plastic shrink tubing insulator 156. For low current, small sizes, a thin-gauge metal wire is inserted in a thin flexible tube filled with conductive ink. When a localized cut 262 occurs in this wire, the conductive ink flows and dries to restore the conductive path (illustrated in the lower half of FIG. 2C).

In some embodiments, the polymer can be self-curing such that the polymer increases in viscosity or even solidifies upon exposure to air. Accordingly, when the self-healing wire is nicked or cut, conductive polymer 154 begins to flow into the cut area, filling a gap or recess in conductive element 153 created by the cut and also starts the curing process as a result of the exposure to air. Again, the viscosity of conductive polymer 154 and cure rate is chosen to allow sufficient polymeric material to flow into the gap in conductive element 153 before curing, yet not low enough to allow the polymer to travel or leak substantially beyond that area prior to curing.

In the embodiments described above, although illustrated as a solid conductor, conducting element 153 can have alternative configurations. For example, a multi-stranded wire or a thin cylindrical conductor 153 might be more desirable for high-frequency applications as compared to a solid conductor. Likewise, conductive inks can be used as well.

Effects on transmission lines such as, for example, the skin effect, can be considered when designing conductor configurations. Additionally, the combined effects of the conductive element 153 and conductive polymer 154 can be considered when determining the characteristics of the transmission line.

At DC, the impedance of a wire having a circular cross section has a resistance $R_0$ per unit length given by:

$$R_0 = \frac{1}{\pi r_0^2 \sigma}$$

Where, the resistance is in ohms/meter, $\sigma$ is the bulk conductivity of the conductor used to manufacture the wire, and $r_0$ is the radius of the wire.

However, above DC, the current density J in a bulk conductor decreases exponentially with depth of penetration from the surface as a function of frequency. This phenomenon, known as the skin effect, can be expressed using:

$$\delta = \frac{1}{\sqrt{\pi f \mu \sigma}}$$

where $\delta$ is a constant called the skin depth, f is the signal frequency, $\mu$ is the magnetic permeability of the conductor, and $\sigma$ is the bulk conductivity (or $1/\rho$ where $\rho$ is the resistivity in ohm-m). The skin depth, or the depth below the surface of the conductor at which the current density decays to 1/e (about 0.37) of the current density at the surface ($J_S$), is an important parameter in describing conductor behavior in electromagnetic fields.

Accordingly, if a circular wire is used with radius a and a length l, the effective resistance of the wire can be calculated as:

$$R = \frac{l}{\sigma(2\pi r\delta - \pi\delta^2)} \cong \frac{1}{\sigma 2\pi r\delta}$$

$$\text{for } a >> \delta.$$

Figure 3:
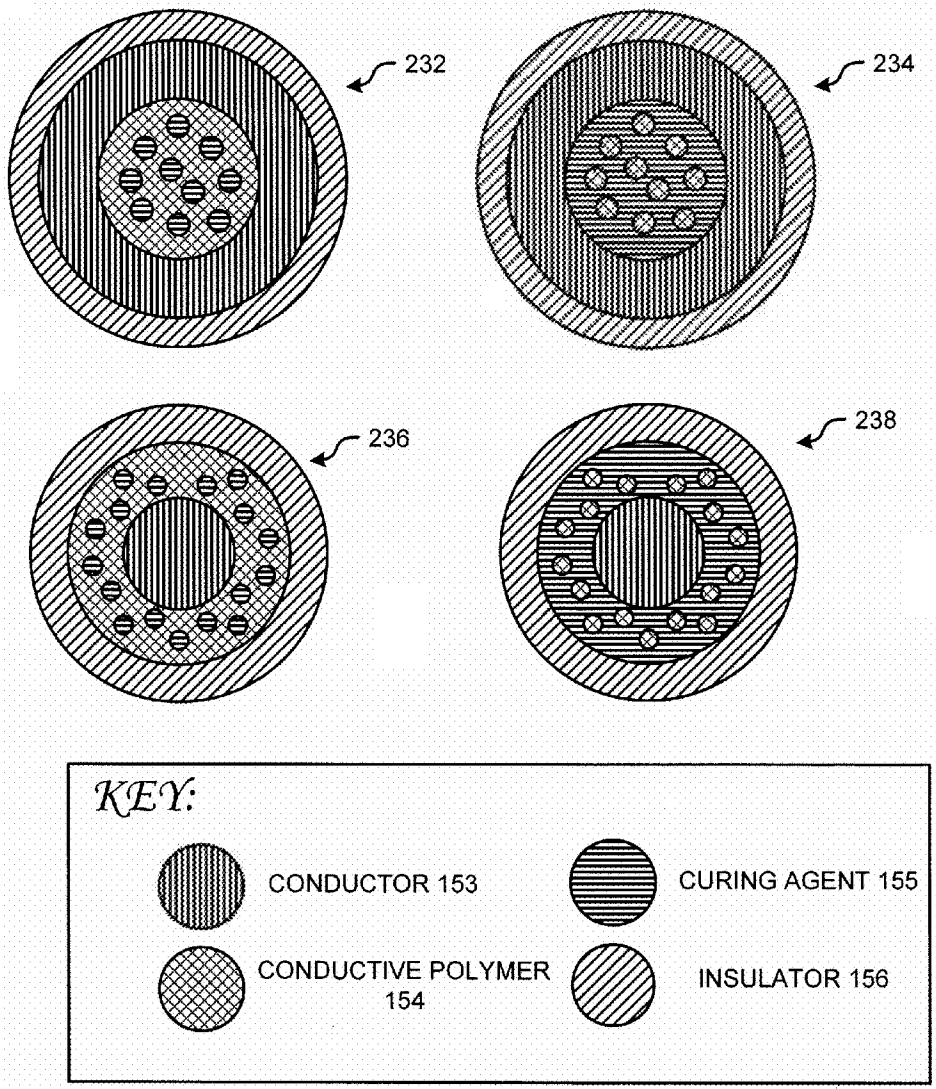
FIG. 3 is a diagram illustrating embodiments wherein either the conductive polymer or the curing agent is distributed in discrete modules in accordance with one embodiment of the invention.

The examples illustrated in the above described embodiments depict implementations where the conductive polymer 154 and the curing agent 155 are in discrete arraignments that can be approximately concentric with one another as well as approximately concentric with the conductive element 153. In other embodiments, one of the conductive polymer 154 or the curing agent 155 can be contained in spheres, capsules, narrow tubes, or other containers distributed within the other element. FIG. 3 is a diagram illustrating embodiments wherein either the conductive polymer 154 or the curing agent 155 is distributed in discrete modules in accordance with systems and methods described herein. Referring now to FIG. 3, the examples at 232 and 234 illustrate embodiments using a ring conductor 153 surrounded by an insulator 156. In these examples, conductive polymer 154 and curing agent 155 are disposed within ring conductor 153. Particularly, in the example illustrated at 232, conductive polymer 154 is disposed within ring conductor 153, and curing agent 155 is contained within spheres, capsules, tubes, or other containers distributed within the conductive polymer 154. The example illustrated at 234 depicts the opposite configuration wherein the curing agent 155 is disposed within ring conductor 153 and conductive polymer 154 is contained within spheres, capsules, tubes or other containers distributing within curing agent 155.

In the examples illustrated at 236 and 238, embodiments utilizing a central conductor 153 are illustrated. In these examples, the composition of polymer 154 and curing agent 155 are disposed in a manner surrounding central conductor 153 and this structure is further surrounded by insulator 156. In the example illustrated at 236, conductive polymer 154 is disposed in an approximate ring-shaped configuration surrounding central conductor 153 and curing agent 155 is contained within spheres, capsules, tubes, or other containers distributed within the conductive polymer 154. In contrast, in the example illustrated at 238, curing agent 155 is disposed in an approximate ring-shaped configuration surrounding central conductor 153, and conductive polymer 154 is contained within spheres, capsules, tubes, or other containers distributed within curing agent 155.

In the examples illustrated at 232, 234, 236 and 238, one of either the conductive polymer 154 or the curing agent 155 is disposed within discrete modules positioned in the other component. As would be apparent to one of ordinary skill in the art after reading this description, it is desirable that the material used to contain the contained element be sufficiently strong so as to keep conductive polymer 154 separate from curing agent 155 during normal use of the self-healing conductor, while at the same time allowing the container to be ruptured upon damage to the structure such that conductive polymer 154 can mix with curing agent 158 in the region of destruction so that curing can commence. It will also be apparent to one of ordinary skill in the art after reading this description that the relative volumes of the conductive polymer 154 and curing agent 155 be selected so as to allow an appropriate amount of curing.

Figure 4:
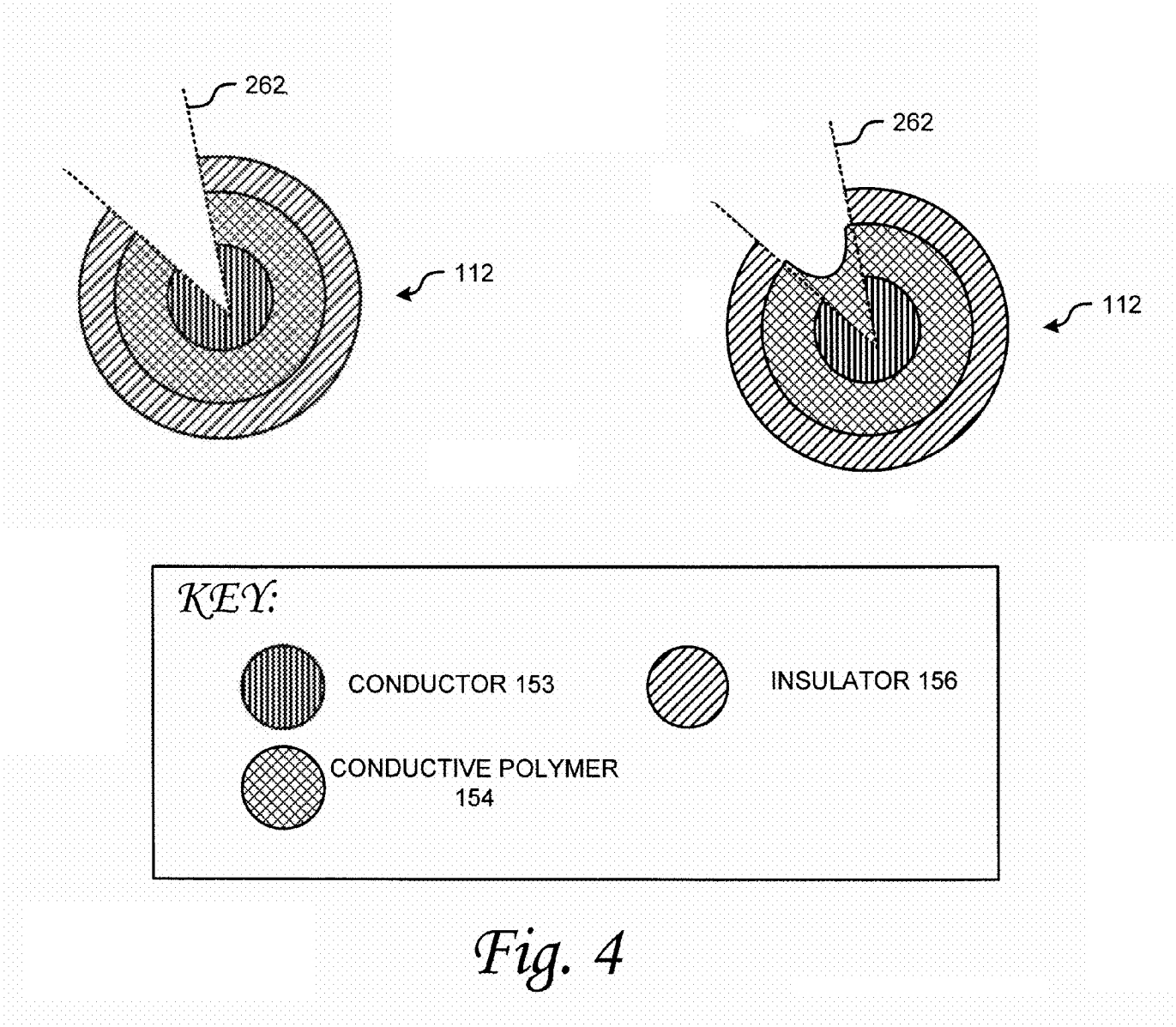
FIG. 4 is a diagram illustrating the flow of conductive polymer in a self-healing conductors in accordance with one embodiment of the invention.

FIG. 4 is a diagram illustrating an example of the flow of polymer with self-healing conductors in accordance with embodiments of the systems and methods described herein. Referring now to FIG. 4, the current example is illustrated in terms of the example embodiment illustrated at 112 and described above with reference to FIG. 2. It will become apparent to one of ordinary skill in the art after reading this description how this principle applies to other embodiments including those embodiments described herein. As illustrated in FIG. 4, damage to the self-healing conductor is illustrated by the cutout defined by dashed lines 262. For example, this can illustrate a cut, nick or other damage to the conductor. As also illustrated in this example, the cut 262 is deep enough to penetrate central conductor 153. As also illustrated in the example of FIG. 4, the right-hand depiction shows conductive polymer 154 flowing into the damaged region of conductor 153 and filling that region. Accordingly, some level of conductivity is restored to conductor 153. In the illustrated example, an air-curing conductive polymer 154 is utilized such that the polymer cures upon contact with air.

Figure 5:
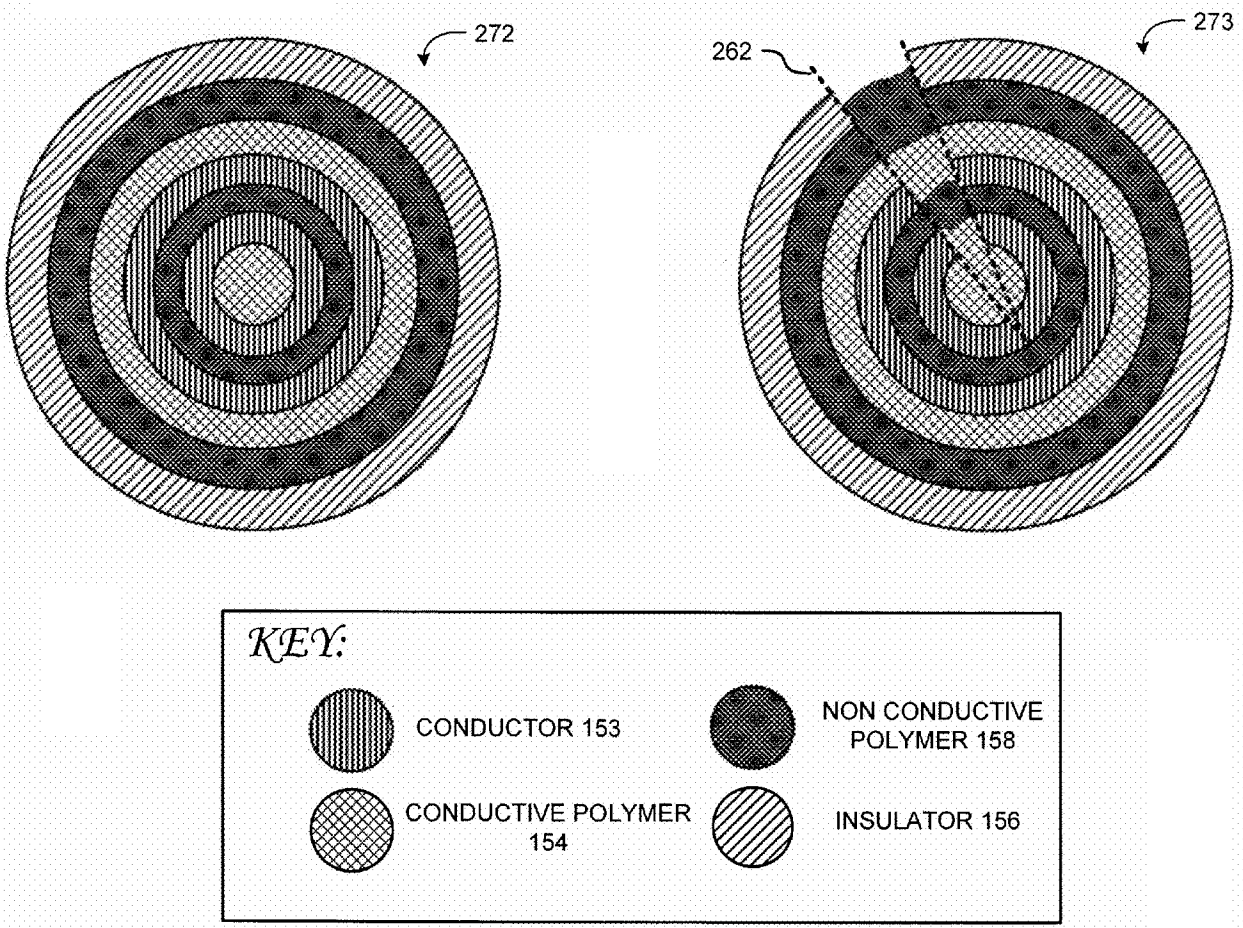
FIG. 5 is a diagram illustrating yet another example of a self-healing conductor using conductive and non-conductive polymers in accordance with one embodiment of the invention.

FIG. 5 is a diagram illustrating yet another example of a self-healing conductor in accordance with one embodiment of the invention. Referring now to FIG. 5, this embodiment as shown at 272 includes a non-conductive polymer 158 as well as a conductive polymer 154 to provide self-healing properties. Particularly, the use of a flowable, curable non-conductive polymer can provide self-healing insulating properties as well. In the example illustrated in FIG. 5, two concentric ring conductors 153 are provided. Non-conductive polymer 158 is disposed between the two ring conductors 153. Accordingly, if damage is incurred, nonconductive polymer 158 can flow to the damaged area to provide insulation between the two conductors 153 and can cure to remain in place. The illustrated example also shows conductive polymer 154 at the center of the assembly to provide self-healing properties to the entire range of conductor 153, and conductive polymer 154 disposed around the outer perimeter of the outer conductor 153 to provide self-healing properties thereto. Additionally, nonconductive polymer 158 is illustrated as being disposed between the outer jacket insulator 156 and the conductive rings to provide self-healing properties to the outer jacket.

In one embodiment, nonconductive polymer 158 is a viscous material such that it can flow into a damaged area. However, nonconductive polymer 158 can have a faster curing rate than conductive polymer 154 such that it does not flow into the damaged areas of conductors 153 in place of conductive polymer 154. As illustrated at 273 in this example, conductive polymer 154 has greater flow than nonconductive polymer 158. Accordingly, conductive polymer 154 moves farther into a damaged area (shown by cut 262) of a conductor than does the adjacent nonconductive polymer 158. This can be accomplished by selection of relative viscosities and cure rates.

Figure 6:
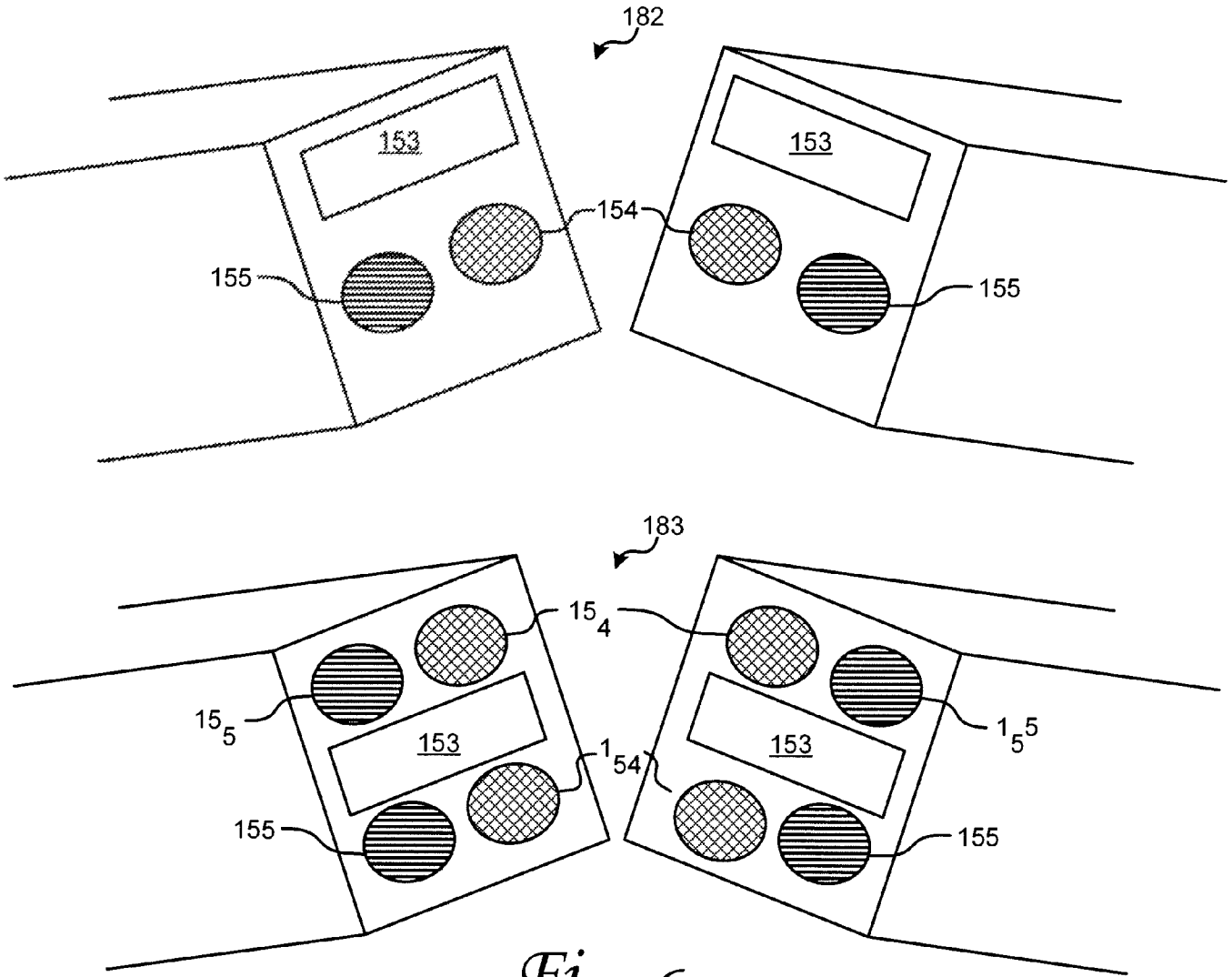
FIG. 6 is a diagram illustrating an example of yet another configuration in accordance with one embodiment of the invention.

As noted, the examples depicted and described above generally refer to configurations wherein conductive elements, polymers, and curing agents are in approximately concentric configurations. Indeed, the present invention is not limited to embodiments wherein these elements are arranged in a concentric or approximately concentric configuration, and one of ordinary skill in the art reading this description will understand other arrangements and configurations are possible within the scope of the inventions. FIG. 6. is a diagram illustrating an example of another configuration in accordance with the systems and methods described herein. Particularly, the examples illustrated in FIG. 6 depict embodiments wherein polymer 154 and curing agent 155 are adjacent to but not necessarily concentric with conductive element 153. In the example illustrated at 182, conductive element 153 is illustrated as running the length of the self-healing wire and being surrounded by insulating material 156. Also illustrated in the example at 182, are regions of conductive polymer 154 and curing agent 155 disposed within separate channels or tracks adjacent to conductive element 153. Accordingly, if the self-healing conductor is damaged conductive polymer 154 and curing agent 155 would escape from their respective channels flow to the damaged area of conductor 153 and cure in place.

With continued reference to FIG. 6, the example illustrated at 183 is similar to the example illustrated at 182, however in the example illustrated at 183 and additional pair of channels to contain conductive polymer 154 and curing agent 155 are included. As these two general example serves to illustrate, additional channels of conductive polymer 154 and curing agent 155 can be included in configurations near, adjacent or about conductive element 153. Although the examples illustrated in FIG. 6 show conductive polymer 154 and curing agent 155, it would be apparent to one of ordinary skill in the art after reading this description that an air-curable polymer can be used as well.

In yet another embodiment, the conductive polymer itself can be the primary conductive element and, accordingly, in such embodiments, a conductive element 153 need not be provided. Instead, all or substantially all of the conductivity of the cable or wire is provided by the conductive polymer. When damaged, the polymer can flow to fill in missing voids of polymer, providing some measure of uniformity along the length of the conductor.

Figure 7:
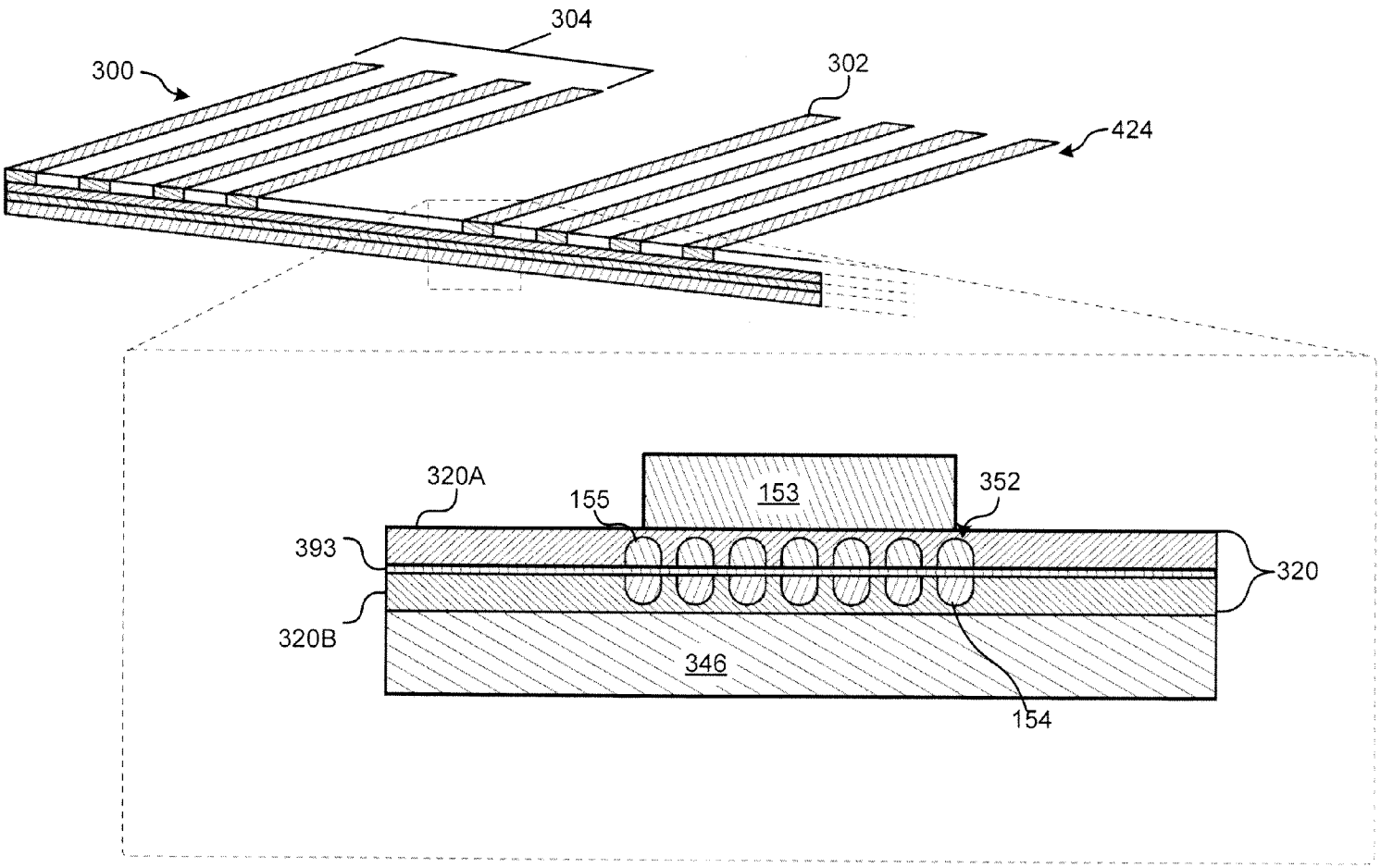
FIG. 7 is a diagram illustrating still another embodiment of self-healing conductors using a multi-layer structure in accordance with one embodiment of the invention.

FIG. 7 is a diagram illustrating yet another example of self-curing communication links in accordance with one embodiment of the invention. The example illustrated in FIG.

7 is a laminate or laminate-like structure 300 that includes a plurality of conductive paths 302 on one layer, and adjacent conductive polymers on another layer to facilitate self-curing. Conductive paths 302 can be made using suitable conductor materials or conductive inks or polymers.

In the illustrated example, the conductive paths 302 are arranged in groups of four paths 302. Such groupings 304 can be used, for example, implement a four-wire USB or six-wire FireWire bus. In one embodiment, conductive ink layer 302 can be approximately 50 μm thick or less.

The foundational layer in this embodiment is a polymer backing layer 346 that can be used to provide structural support as well as suitable adhesion to textile materials used in the electrical garment. Polymer backing layer 346 can be a thin insulating layer such as urethane, silicon, or other like polymer. In one embodiment, polymer backing layer 346 is less than 100 μm thick.

Embossed micro pattern layer 320 in this example includes a plurality of micro muffin pans 352 adjacent conductive ink paths 153. Micro muffin pans 352 can be configured to contain curable conductive polymers to provide self-healing functions as described above. The illustrated example includes conductive polymers 154 and curing agent or catalyst 155 separated by a barrier lamination 393. However, in another embodiment, an air-curable conductive polymer can be utilized obviating the need for a curing agent 155.

Figure 8A:
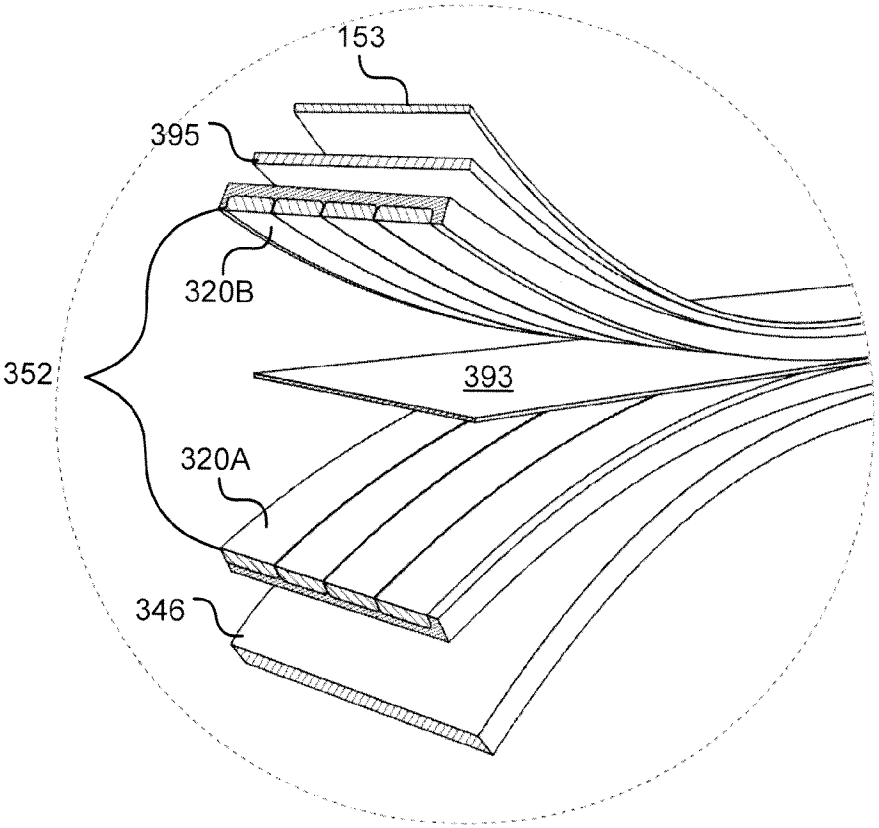
FIG. 8A is a diagram illustrating an exploded view of an example self-healing conductor using a multi-layer structure in accordance with one embodiment of the invention.
Figure 8B:
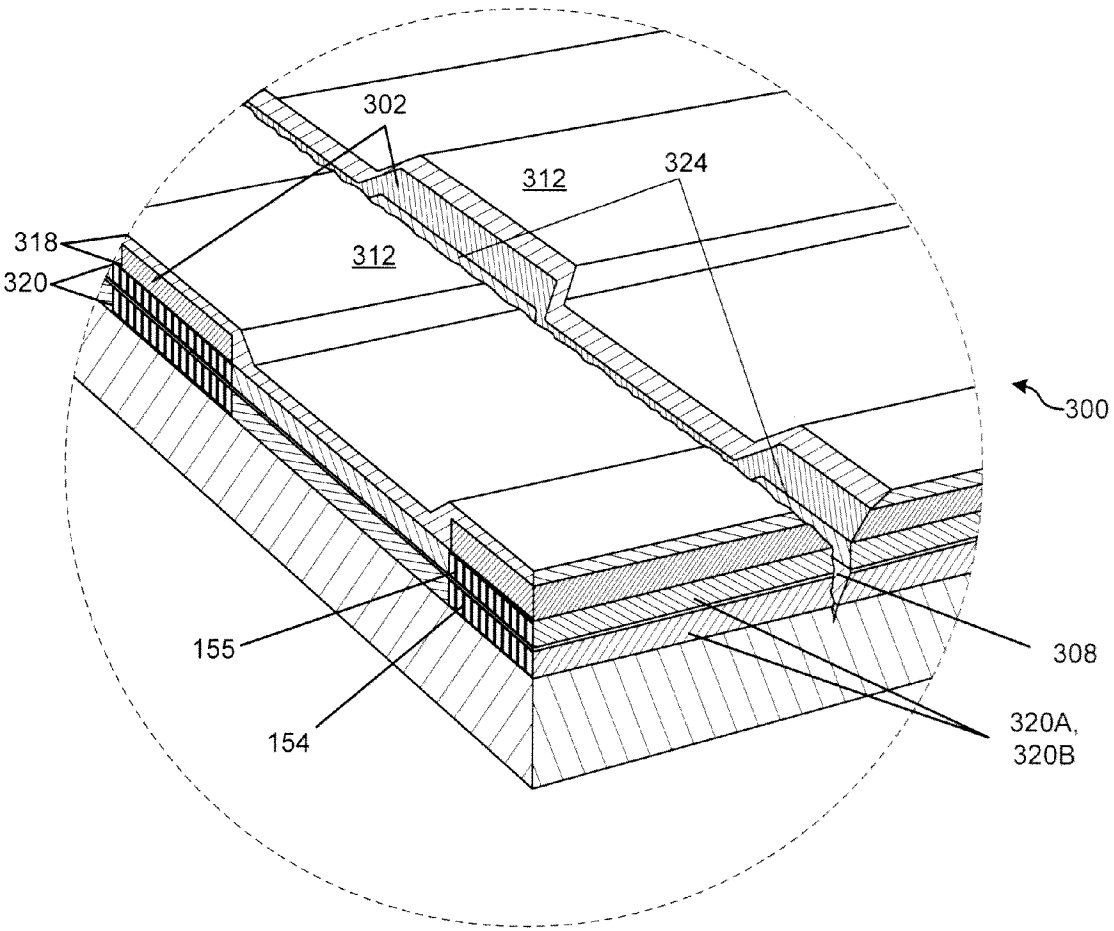
FIG. 8B is a diagram illustrating a repaired break of self-healing conductors using a multi-layer structure in accordance with one embodiment of the invention.

FIGS. 8A and 8B illustrate alternative views of the example illustrated in FIG. 7. FIG. 8A is a diagram illustrating an exploded view of an example multilayer structure in accordance with one embodiment of the invention. This view shows the individual layers discussed above with reference to FIG. 7, including the backing layer 346, micro-pattern layers 320A, 320B with barrier lamination 393, and conductive path 302. Also shown is an insulating polymer 395 between micro-pattern layers 320A 320B and conductive ink paths 302.

FIG. 8B is a diagram illustrating another view of the example illustrated in FIG. 7, but with a tear or break in the communication paths. Referring to FIG. 8B, this view shows a tear or break 308 across a plurality of conductive ink paths 302. When this tear occurs, micro muffin pans 352 are also cut causing conductive polymer 154 to mix with curing agent 155 and allowing the mixture to flow into the area of the cuts that is through conductive ink paths 302. This results in a cured conducting patch 324. As this example illustrates, separation between conductive ink paths 302 can be selected to be large enough such that the conductive polymers or gels do not flow far enough to span the distance between adjacent paths 302 to cause a short.

Also illustrated in FIG. 8B is an insulating polymer 312 deposited over the conductive paths 302 to provide insulation as well as protection to the conductive paths 302. The structure that includes conductive paths 302 and insulating polymer 312 is referred to as a conductive layer 318 in FIG. 88.

Figure 9:
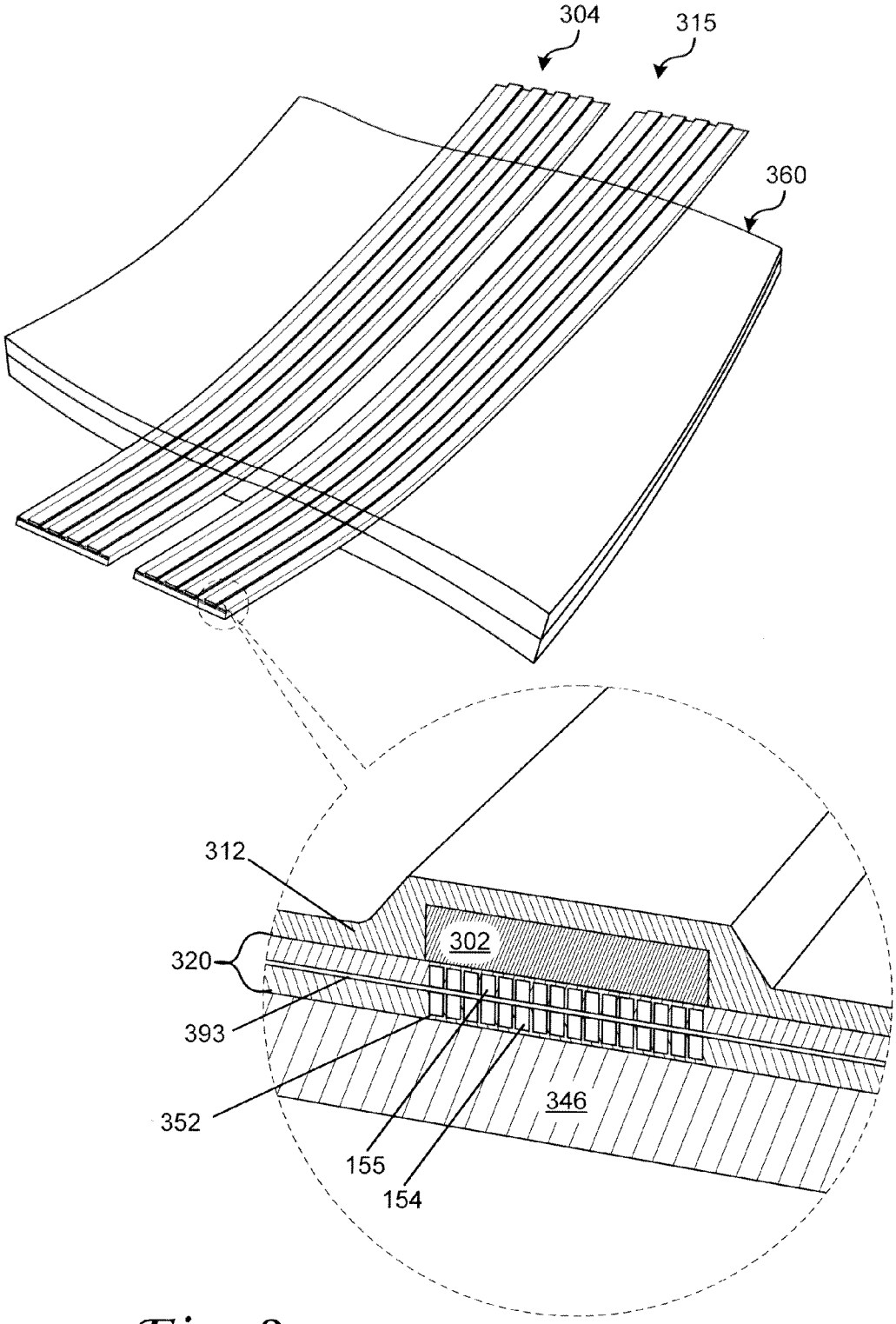
FIG. 9 is a diagram illustrating another view of the embodiments shown in FIGS. 7, 8A and 8B, and the integration of conductor cables in textile material in accordance with one embodiment of the invention.

FIG. 9 is a diagram illustrating the physical layer implemented as a ribbon-type cable and embedded within textile materials in accordance with one embodiment of the invention. In this illustrated example, the conductor/polymer structure or stack 300 is fabricated to have a group 304 of four conductive paths 302. Accordingly, this stack forms a ribbon cable 315 having four conductors running in parallel. As illustrated, a plurality of cables 315 can be attached to a textile material 360 or laminated between layers of textile materials 360. Cables 315 can be fixed to textile 360 by stitching, adhesives, or other means.

As the above example illustrates, the physical layer can be a multilayer sandwiched or laminate structure comprised of the several layers form on top of one another such as those illustrated in FIGS. 7, 8 and 9. The polymer backing layer 346 can be a thin layer of insulating polymer such as a urethane. Other materials that provide flexibility with the garment and good adhesion to the textile can be selected. The embossed micro-pattern layer 320 can be formed on top of the polymer base layer 346. In one embodiment, the embossed micro-pattern layer 320 includes two layers 320A, 320B that can be either fabricated one on top of the other or independently fabricated and then laminated together. In the illustrated examples, the embossed micro-pattern is created on the embossed micro-pattern layer 320 layer as shown in FIGS. 7, 8 and 9. This pattern can be in the form of a number of open capsules, pits or other small cup-like containers 352 that hold one component (e.g., the conductive gel or polymer 154) of the self-healing agents. In one embodiment, they are fashioned such that they resemble miniature muffin pans with a plurality of indentations arranged in a closely spaced array to hold the agent. Trapezoidal, rectangular and other shaped structures can be used. In one embodiment, they are made with aspect ratios of up to 4:1. The containers 352 and can be filled by a method such as dip coating. A press frame (one adjustable to 1000 N/cm2 is sufficient) of steel construction or other like construction can be used to make the embossments. Two example types of substrates suitable for embossing are: polycarbonate (230° F.-250° F.) and acrylic (160° F.-180° F.). Others can be used as well.

A thin barrier polymer layer or laminate 393 is then applied over the filled layer 320B. A similar layer 320A with the second component (catalyst) is created and the two layers are sandwiched together as illustrated. Alignment reticles can be provided to facilitate alignment of the layers. Conductive paths 153 (for example, conductive ink or metal wires) are then laid over the embossed micro-pattern layer 320 in alignment therewith as illustrated in FIG. 7. As shown in FIG. 8, a layer of insulating polymer 312 can be deposited over conductive trace 153 to provide insulation, a hermetic seal to the conductor and some degree of physical protection.

An example of a conductive ink that can be used in the physical layer is the 101-42 silver-based conductive ink manufactured by Creative Materials Incorporated, Tyngsboro, Mass. This ink is suitable for application by stamping, screen printing, dipping, and syringe dispensing, exhibits excellent adhesion to a variety of polymeric surfaces, including Kapton and Mylar as well as excellent crease resistance. Some relevant properties of this ink are tabulated in Table 1. It will be apparent to one of skill in the art after reading this description how alternative inks can be selected for various applications based on their properties.

TABLE 1

| | |
|---|---|
| Conductive filler | Silver |
| Percent silver upon cure | >85% |
| Volume Resistivity (ohm-cm) | $4 \times 10^{-5}$ |
| Sheet Resitivity (ohm/sq.) | 0.015 |
| Glass Transition temperature (° C.) | 75 |
| Hydrolytic Stability | Excellent |
| Useful temperature range (° C.) | −55 to +200 |
| Thermal Stability (° C.) | Good to 325 |
| Pencil Hardness, min. | 2H |

Because with traditional polymers, the valence electrons tend to be bound in covalent bonds, these traditional polymers tended to be electrical insulators. In other words with such traditional polymers, there are typically no mobile electrons to cause conductivity or electrical conduction. In the natural state thermoplastic polymers typically exhibit surface resistivities of $10^{12}$ to $10^{16}$ ohm-meters. Such resistivities yield poor electrical conductors. As noted above, because of this very poor level of conductivity, traditional polymers are often used as coatings for insulation and the like.

Conductive polymers, conductive inks, conductive epoxies or other flowable conductive materials can be utilized. Conductive polymers can be based on, for example, carbon chains having, for example, 6 electrons, of which 4 are valence electrons that can take part in chemical bonds. When additional electrons are introduced into the conduction bands the electrical conductivity increases. Additionally, polymers can be doped to sufficiently high carrier densities so that could conductive properties are achieved.

Conductive polymers in various embodiments can generally be classified as those materials with surface resistivities from $10^1$ to $10^7$ ohm-meters, although other levels of resistivity might be achieved. To achieve sufficient electrical conductivity in polymers, electrically conductive additives can be added to the polymer. For example carbon additives can be used to increase conductivities. Additionally, highly conductive elements can be added as well.

The conductive polymer 154 in these and other embodiments is preferably configured to flow into a nick, cut or other break in the conductive element so as to provide a self-healing properties to conductive elements 153. Preferably, the viscosity of conductive polymer 154 is chosen so as to provide adequate flow to fill or replace the damaged portion of conductive element 153 while not having such a high viscosity that flow is excessive or uncontrollable. For example, in one embodiment, the viscosity of the conductive polymer 154 is chosen in part based on the distance between the conductive polymer 154 and conductive element 153 so that the polymer can flow to the conductive element 153 while not having excessive leakage of conductive polymer 154 from the self-healing wire. In other embodiments, the viscosities and materials can be chosen to optimize cure time such that conductive polymer 154 remains uncured for a sufficient amount of time to reach conductor 153 yet cures before it transcends the dielectric or other material so that the conductive polymer 154 does not reach the shield or other conductive element in the wire or cable thereby causing a short.

Figure 10:
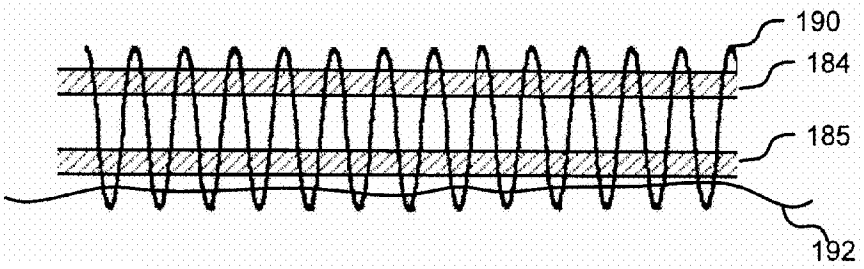
FIG. 10 is a diagram illustrating an example embodiment utilizing self-healing conductors stitched into a fabric or garment in accordance with one embodiment of the invention.

FIG. 10 is a diagram illustrating an example embodiment utilizing self-healing conductors stitched into a fabric or garment in accordance with one embodiment of the invention. Referring now to FIG. 10, an example is shown where two fabric portions are joined together by conventional stitching methodologies. Particularly, in the illustrated example, a type of lockstitch is used, which uses two threads, an upper and a lower. The top thread 190 is stitched across two garment portions 184 and 185 and held in place by the lower thread, or bobbin thread 192. The upper thread is typically run from an upper spool and through the eye of the needle. Accordingly, it is the upper thread or top thread 190 that is pushed through the garment portions 184 and 185 by the needle. In some applications, the lower thread or bobbin thread 192 is wound onto a small real referred to as a bobbin, which is typically housed in the machine below the needle and below the fabric being stitched. In operation, the machine forces the threaded needle through the fabric portions into the bobbin area. A hook catches top thread 190 and carries the upper thread around the bobbin case to wrap the bobbin thread. A take up arm is generally employed to pull the excess upper thread back to the top portion of the fabric and the needle is removed from the cloth. Feed dogs can be used to pull the fabric portions through the machine one stitch length based on the desired stitch pattern.

In one embodiment, the fiber or thread used for either or both of the top thread 190 or bottom thread 192 can be implemented utilizing a self-healing conductor such as those described herein. For example, in one embodiment, self-healing conductor or wire can be used to replace the bobbin thread for the sewing operation. Depending on the materials utilized, this might be desirable in some embodiments as the bobbin thread tends to be shorter than the main thread and also tends to run in a straighter line. Of course, these factors can be based on machine settings and, indeed, in some applications the bobbin thread may be run in a pattern similar to that of the upper thread.

Figure 11:
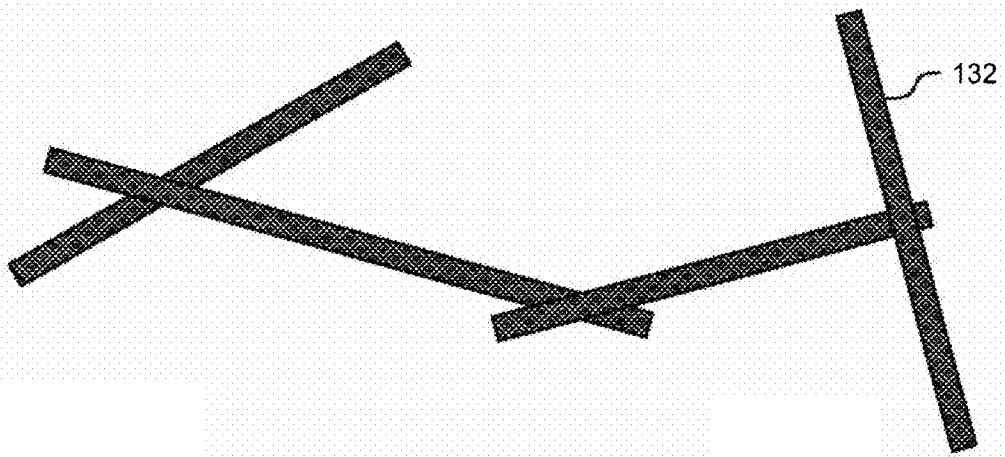
FIG. 11 is a diagram illustrating an example of utilizing carbon nanotubes to increase the conductivity of conductive polymer in accordance with one embodiment of the invention.

FIG. 11 is a diagram illustrating an example of utilizing carbon nanotubes to increase the conductivity of conductive polymer 154 in accordance with one embodiment of the invention. As illustrated in FIG. 11, carbon nanotubes 132 in this example exhibit a long aspect ratio, or a high length-to-diameter ratio. Accordingly, as the example illustrates, overlap can be achieved with a relatively low quantity of nanotubes, resulting in good conductivity with a small percentage of carbon content added to the polymer. As also noted above, in some embodiments air-curable polymers can be utilized such that the polymer can be cured without the use of curing agents. Accordingly, in one embodiment, the carbon polymer can be thought of as "carbon blood" because, like human blood, it coagulates or cures upon contact with air.

In one embodiment, self-healing conductors or wires can be made of a sufficiently flexible material and a sufficiently small diameter such that they can be easily integrated into materials such as fabrics for garments including electrical garments, electrical textiles, electrical clothing, and electrical wearables such as those described above with reference to FIG. 1. Indeed, in one embodiment, the self-healing conductors can be sewn into a garment using conventional stitching methods such that one or more conductive paths can be integrated with the garment fabric portions thereof or other materials.

Electrical garments and other like articles can include other mechanisms for self-healing communications as well. For example, in addition to or in place of self-healing wires or conductors that physically restore conductivity of broken conducting elements, automatic restructuring or redundancy of communication paths can be included. In some embodiments multiple, redundant communication paths can be provided between various communication nodes to allow for failover if one of a set of redundant communication paths is damaged or otherwise fails. The redundant communication paths can be implemented using self-healing conductors to add an additional layer of redundancy.

Figure 12:
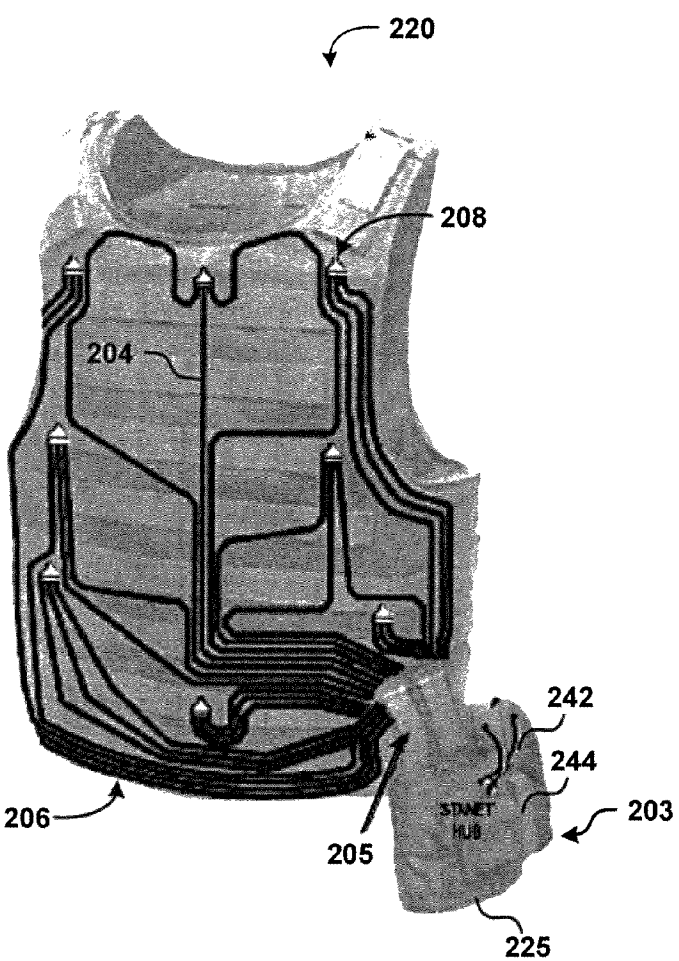
FIG. 12 is a diagram illustrating an example of an electrical garment in accordance with one embodiment of the invention.

FIG. 12 is a diagram illustrating an example of an electrical garment in accordance with one embodiment of the invention. Referring now to FIG. 12, the example illustrated is of a tactical military vest 220 having a network of communication paths 204 traversing the vest. In the illustrated embodiment, the communication paths 204 are configured into a set of multiple redundant paths 206 to provide failover redundant communication paths 204 in the event of failure of one of the paths 204 in the group. In one embodiment, self-healing communication paths, such as those described above, can be utilized to provide a measure of reliability, especially in battlefield or other hazardous applications.

Connectors 208 are provided at the terminal ends of the communication paths 204 to allow electronic devices or other equipment to be attached thereto. In one embodiment, connectors 208 can be USB connectors, although other connector standards or configurations can be utilized. In further embodiments, connectors 208 can include circuitry to facilitate signal selection and switching among a plurality of communication paths of 204 in a group of paths 206. Connectors can also include other configurations such as, for example, those described in United States patent application publication number 2007/0105404, to Lee et al., assigned to the Physical Optics Corporation.

In the embodiment illustrated in FIG. 12, a smart pouch 203 can be included to provide capability to house and carry electronic equipment such as, for example, a computing device, a power source, communications gear, navigation equipment, test equipment and so on. Connection 205 can be included to allow the equipment in smart pouch 203 to interface to the garment 220, and ultimately to devices connected to the garment 220. Although, not illustrated, garment 220 can include pockets to house equipment as well as attachment points for additional pouches to hold equipment. This equipment can be electrically connected to vest by connectors 208, and thus interfaced to smart pouch 203 or other equipment connected to the garment 220.

Figure 13:
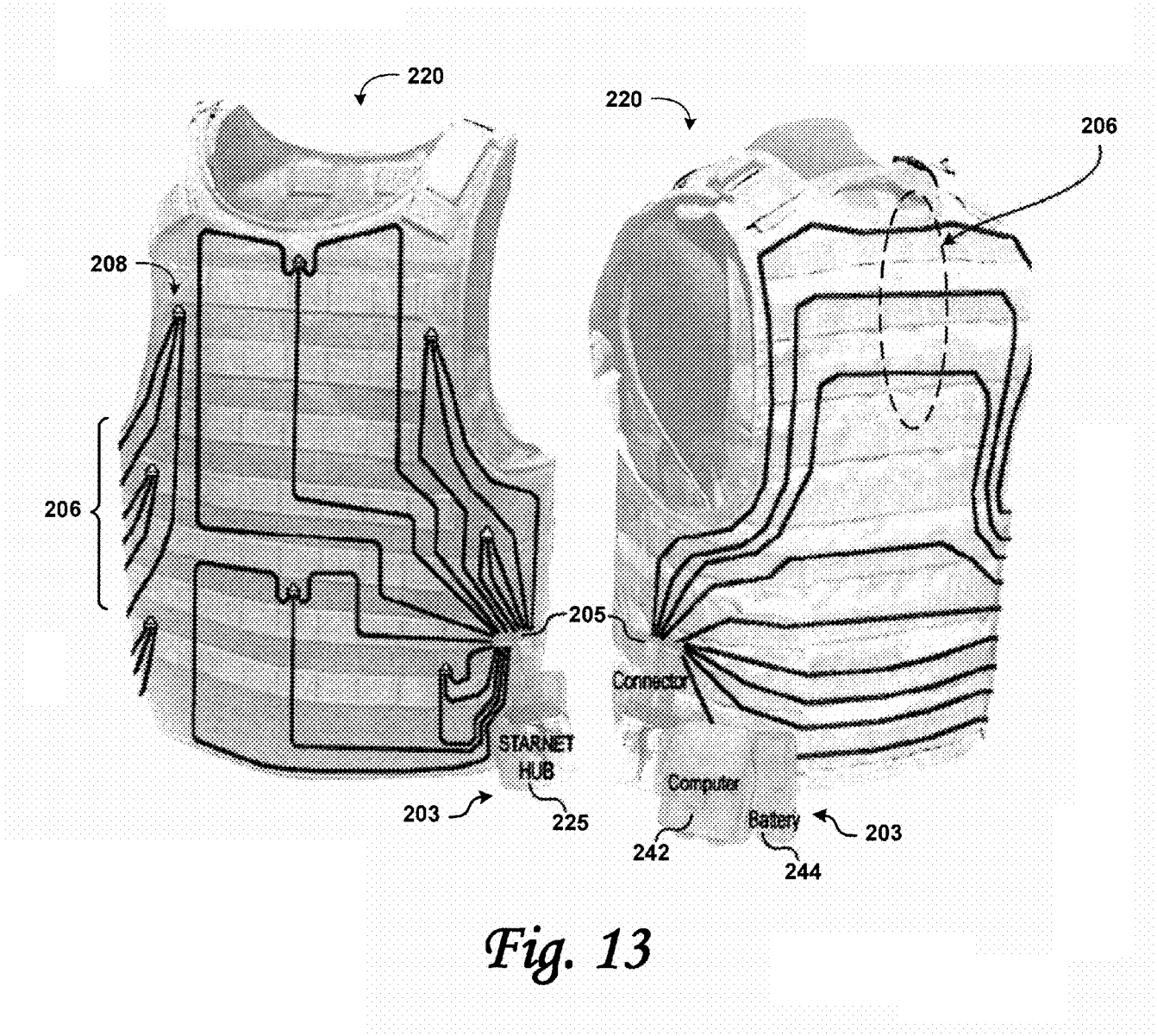
FIG. 13 illustrates front and back views of another example electrical garment configuration in accordance with one embodiment of the invention.

FIG. 13 illustrates front and back views of another example electrical garment configuration in accordance with one embodiment of the invention. In the embodiment illustrated in FIG. 13, the example vest 220 also includes a plurality of communication paths 204, with redundant paths shown as groups 206. In this example, however, the individual communication paths 204 that make a group of redundant paths 206 are separated by a greater distance than those illustrated in FIG. 12. Accordingly, if one section of the garment 220 sustains damage and a communication path 204 in that area is damaged, there is a greater likelihood that other communication paths 204 in the same group 206 remain undamaged.

Accordingly, in configuring an electrical garment 220, connection points and connectors 208 can be arranged and placed to take into consideration routing of redundant paths 204 to increase reliability, as well as ergonomics to provide ease of use and accessibility of equipment. With the use of self-healing communication paths and redundant groups thereof, multiple levels of reliability can be provided in the garment. For example, if a self-healing communication path 204 is nicked or damaged, the conductive polymer can flow to repair the damage and coagulate to stop the flow. Accordingly, an individual communication path 204 itself can have some level of fail-safe protection built in. However, providing redundant groupings 206 of communication paths 204 can provide an additional layer of protection to account for a circumstance where an individual communication path 204 is damaged beyond the point at which it can self-repair by the self-healing mechanism.

Note that in the example illustrated in FIG. 13, the communication paths 204 are shown as being distributed with greater spacing on the front and rear between individual paths 204 of a group 206, and closer spacing on the sides. This illustrates an example of how location, routing and configuration/geometry can be made taking into consideration the probability of damage. For example, where garment 220 is a tactical military vest, damage from gunshots and shrapnel is statistically more likely to be sustained at the front and rear portions than it is to be sustained at the sides.

In the illustrated examples, smart pouches 203 are shown as housing a computer 242, a battery 244 and a communication hub 225. In such embodiments, battery 244 can be included to provide a source of power to computer 242 and hub 225 as well as to other equipment connected to the vest 220 such as by connectors 208. Accordingly, an electronic network can be provided for the garment 220.

Note that for the designs illustrated in FIGS. 12 and 13, a redundancy factor equal to three is provided. That is, for the links between the pouch and equipment, the redundant groupings 206 comprise three redundant communication paths 204.

Figure 14:
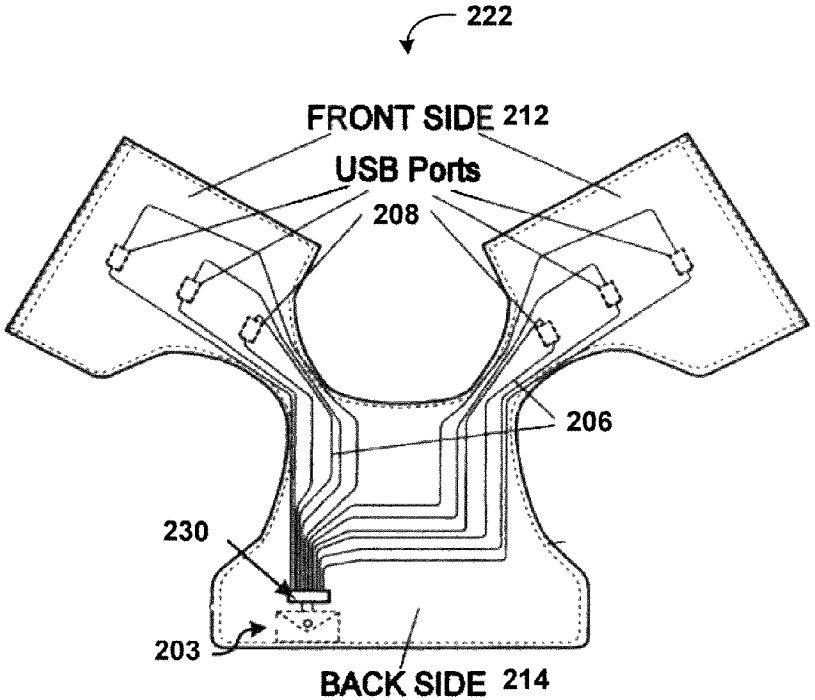
FIG. 14 is a diagram illustrating an example of an insert that can be retrofitted to an electrical garment in accordance with one embodiment of the invention.

In one embodiment, the network or series of communication paths 204 can be provided as an insert for application to the electrical garment. FIG. 14 is a diagram illustrating an example of an insert 222 that can be retrofitted to an electrical garment 220. For example, in some embodiments the series of communication paths 204 and interface elements such as appropriate connectors can be secured to an insert that is cut to fit the garment 220. The insert 222 can include portions that will correspond with the garment such as sleeve portions, collar portions, cuff portions, front and side panel portions and so on. In the illustrated example, a back side 214 and two front side panels 212 are illustrated. Also shown in FIG. 14 is a dashed-line representation of where a smart pouch 203 might be connected along with a hub connector 230.

The insert 222 is then stitched or otherwise secured to or mated with the electrical garment 220. For example, in one embodiment, the insert 222 can be a liner for the electrical garment, and it can be sewn or otherwise affixed to the garment as an inner our outer liner. As another example, the insert 222 can be disposed between an outer shell and an inner shell of the garment 220. As a further example, in the case of a tactical military vest 220, the vest might be comprised of a durable outer layer such as a nylon or Cordura® layer, an inner liner such as a nylon liner, and the insert 222 disposed between the two layers. Such configurations can be beneficial for various reasons. For example, the tough outer layer can help protect the communication paths 204. Similarly, a reasonably tough but relatively comfortable inner layer functioning as a liner can protect the insert from abrasion resulting from contact with the human body and also provide the wearer with more comfort. As another example, the insert 222 can be disposed between inner and outer layers of an article of GEN III military outwear. It may be desirable to properly seal openings wear connectors or other elements protrude through the outer layer or inner liner to ensure a waterproof fit or to ensure continued compliance with garment specifications as regards to levels of waterproofness or water resistance, moisture vapor transfer rate, dynamic absorption, or other properties.

Figure 15:
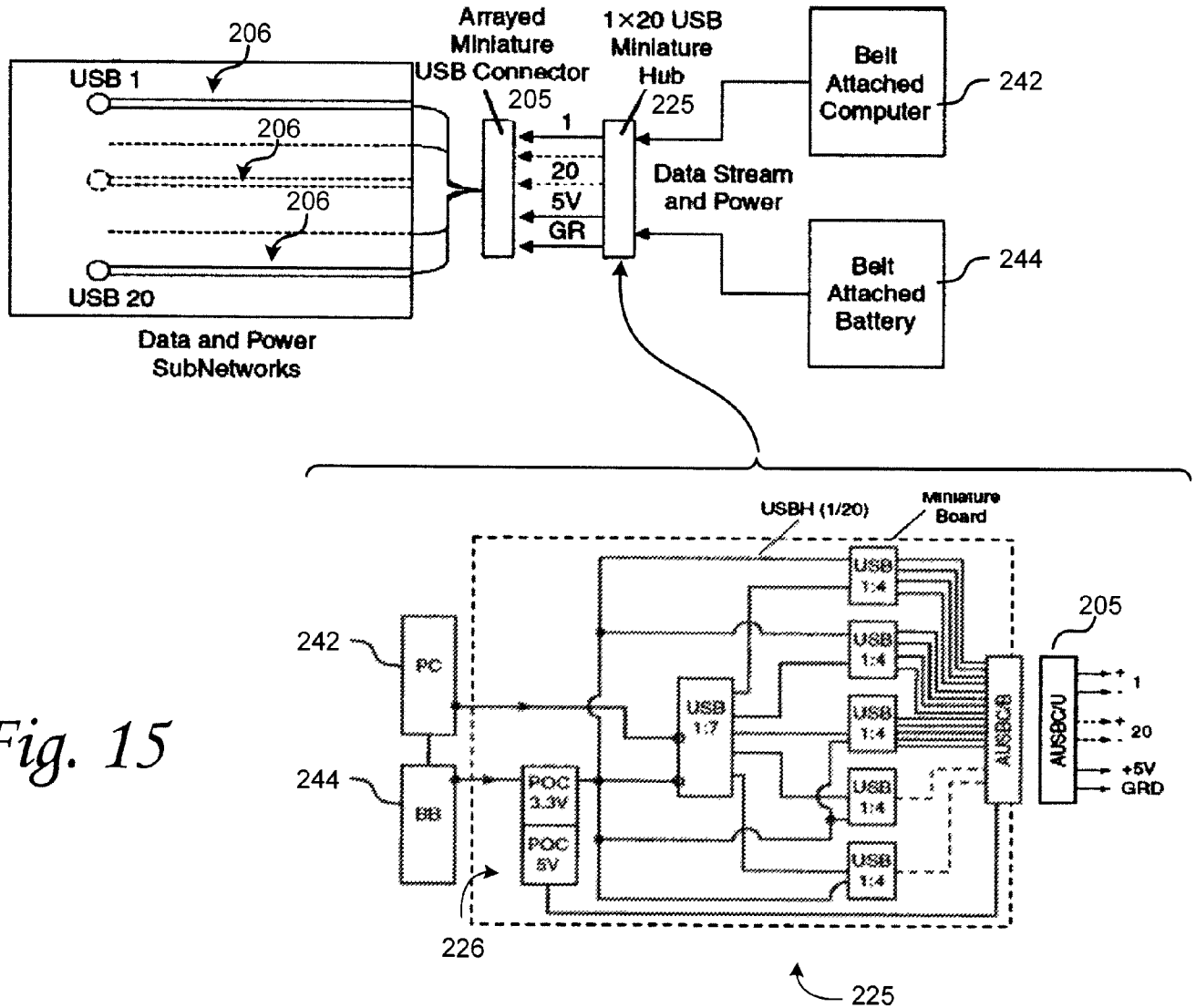
FIG. 15 is a diagram illustrating a schematic representation of an example electrical garment network in accordance with one embodiment of the invention.

FIG. 15 is a diagram illustrating a schematic representation of an example electrical garment network in accordance with one embodiment of the invention. Referring now to FIG. 15, illustrated are a belt-attached computer 242 and belt-attached battery 244 that can be included with the network. These items can be placed in a smart pouch 203, a smart pocket (not shown) or otherwise attached to the garment 220. The items can be releasably attached so that they can be removed for service, for remote use or to allow the garment 220 to be washed.

In the illustrated example, a miniature hub 225 is provided to allow the computer 242 and battery 244 to interface to the communication paths 204. An example of a hub 225 is also illustrated in the blow-up view provided at the bottom half of FIG. 15. Referring now to the blowup view at the bottom of the figure, the computer 242 and battery 244 are shown at the left-hand side of this diagram. Data from the computer 242 is fed into a plurality of splitters (USB 1:7 and a USB 1:4). Although illustrated as a one-way communication path, one of ordinary skill in the art will appreciate that these can be two-way communication paths. Also illustrated in this example is a voltage divider 226 configured to provide DC voltages to the USB splitters or directly to the output connector. In the illustrated example, voltage divider 226 and the USB splitters are housed on a miniature circuit board illustrated by the dashed lines. An electrical connector can be provided at the edge of the circuit card to mate with the USB connector 205.

In the illustrated example, five of the seven available outputs of the USB 1:7 splitter are utilized and each fed into a USB 1:4 splitter. Accordingly, the USB interlace to the attached computer 242 is effectively split into 20 separate USB paths. This is illustrated at the top half of FIG. 15, where redundant groupings 206 are shown by the designations USB 1 . . . USB 20.

Figure 16:
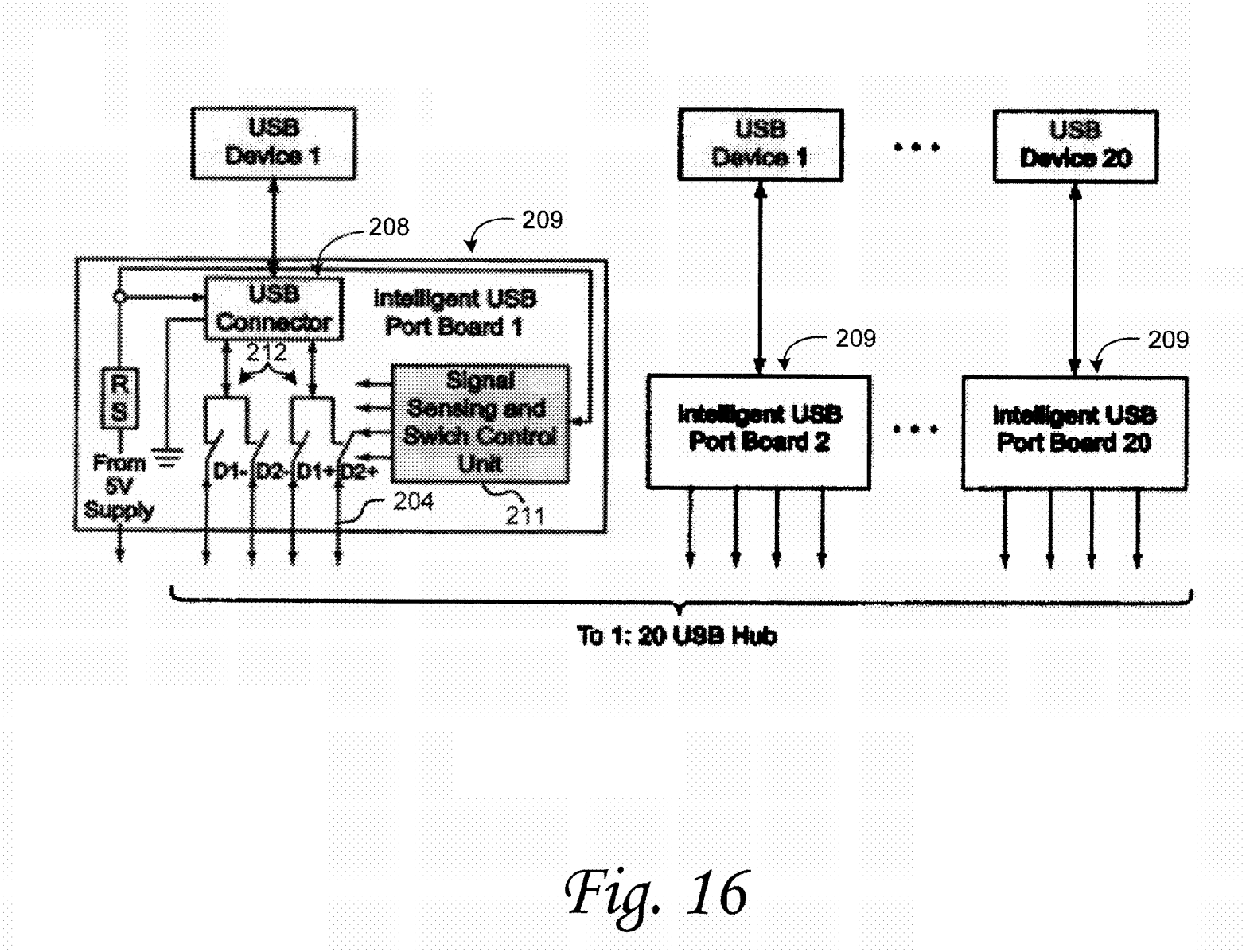
FIG. 16 is a simplified block diagram illustrating an example configuration for one embodiment of a USB connector with an intelligent port board in accordance with one embodiment of the invention.

FIG. 16 is a simplified block diagram illustrating an example configuration for one embodiment of a USB connector 208 with an intelligent port board 209 in accordance with one embodiment of the invention. In this example implementation, USB connector 208 is provided in conjunction with circuitry to perform signal sensing and switching to allow automatic failover in the event a communication path 204 in a grouping of communication paths 206 fails. In this embodiment, a signal sensing and switch control unit 211 is provided in configured to sense signals on communication paths 204. Signal sensing and switch control unit 211 also controls a plurality of switches 212 such that the various communication paths 204 can be switched into or out of the circuit. Accordingly, an active path 204 can be monitored for the presence of a signal, signal strength, signal-to-noise ratio, bit error rate, or other characteristics. In the event signal sensing and switch control unit 211 determines that the active path has been compromised, a backup path 204 can be switched into the active circuit. Likewise, these new paths can be monitored as well. In one embodiment, all paths can be monitored simultaneously in the best path selected for use in the active circuit.

Figures 3, 4, 5, 6, 7, 17:
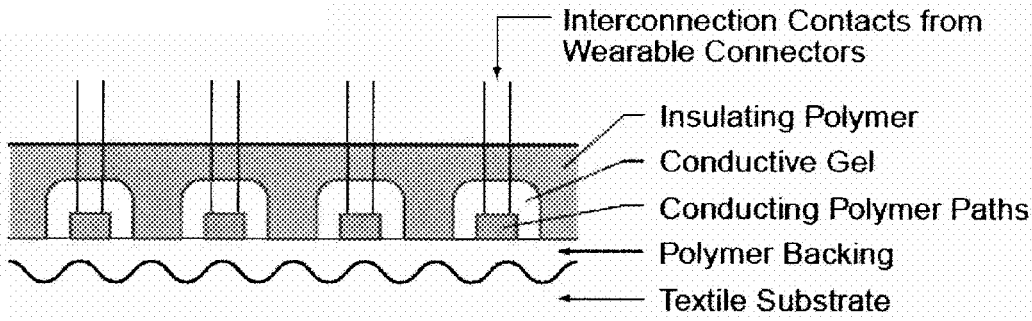
FIG. 17 is a diagram illustrating the use of curable conductive polymers for self-healing interconnects in accordance with one embodiment of the invention.

As noted above, self-healing technologies can also be used to provide self-healing interconnections. These can be provided, for example for connections between the physical communication media and connectors 123 and other devices. FIG. 17 is a diagram illustrating an example of using conductive polymers 154 to form a self-healing interconnection in accordance with one embodiment of the invention. Referring now to FIG. 17, consider the example of connecting communication media 128 to smart connectors 123. The contacts between the interconnection contacts/contact pins from the wearable connectors 123 and the conducting polymer paths can be encapsulated in a conductive gel or polymer 154. A loss of contact between the conducting polymer wire/pathway and the interconnection contacts is restored by the flow of the conducting gel 154 into the gap or crack. In one embodiment, for example, the conductive polymer 154 can be provided in a sealed housing surrounding the interconnect. If the wire separates from the contact pin such as, for example, through vibration, flexing or other mechanism, the polymer provides continuity. If sufficient damage is sustained to rupture the housing, the polymer 154 cures to maintain the connection and can act as a strain relief as well.

Figure 18:
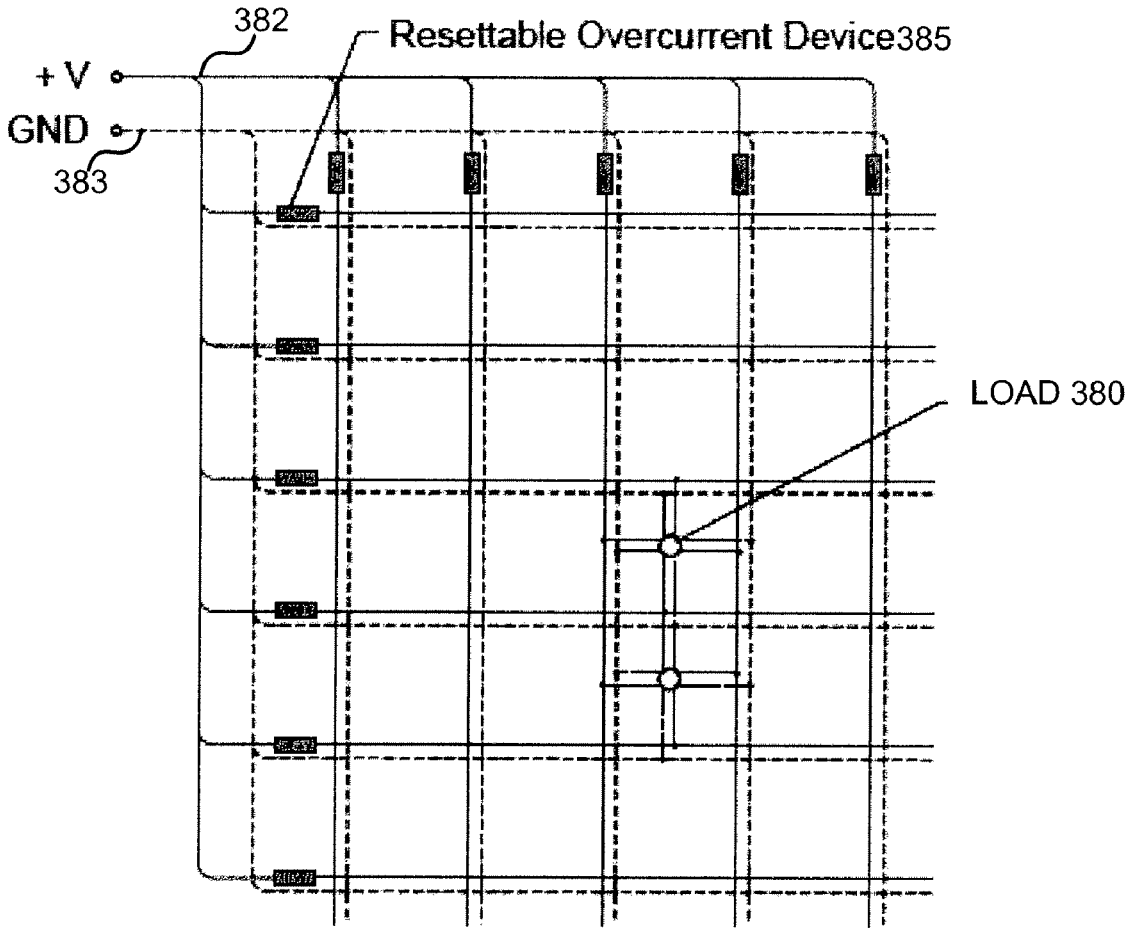
FIG. 18 is a diagram illustrating the attachment of loads to a redundant power network in accordance with one embodiment of the invention.

FIG. 18 is a diagram illustrating an example power network architecture in accordance with one embodiment of the invention. As seen in this diagram, parallel paths of the physical layer conductors/wires (such as, for example, self-healing conductors as outlined above) carry power to a load 380. Examples of loads 380 can be devices connected to the garment such as, for example via connectors 208 or connectors 123.

For a power network, two insulated layers (indicated by the solid lines 382 and dotted lines 383) are connected to the positive and ground terminals of a power supply. Two loads 380 are attached via wearable connectors attached to the power network shown in FIG. 18. Each load is connected to the positive and the ground at four distinct points for quadruple redundancy in the power delivered to the device. If a break occurs at any point, three other connections can continue to carry power. If a short occurs in the power network, then that particular row/column of the grid needs to be taken out of the circuit. This can be accomplished by resettable overcurrent protectors 385 that are connected in series with each of the row and column wires connected (to a positive or the ground terminal. These can be commercially available overcurrent protectors such as the MF series of resettable devices available from Digi-Key. An advantage of using small devices is that a large number of such devices can be incorporated into the garment without noticeably increasing the bulk of the system.

Figure 19:
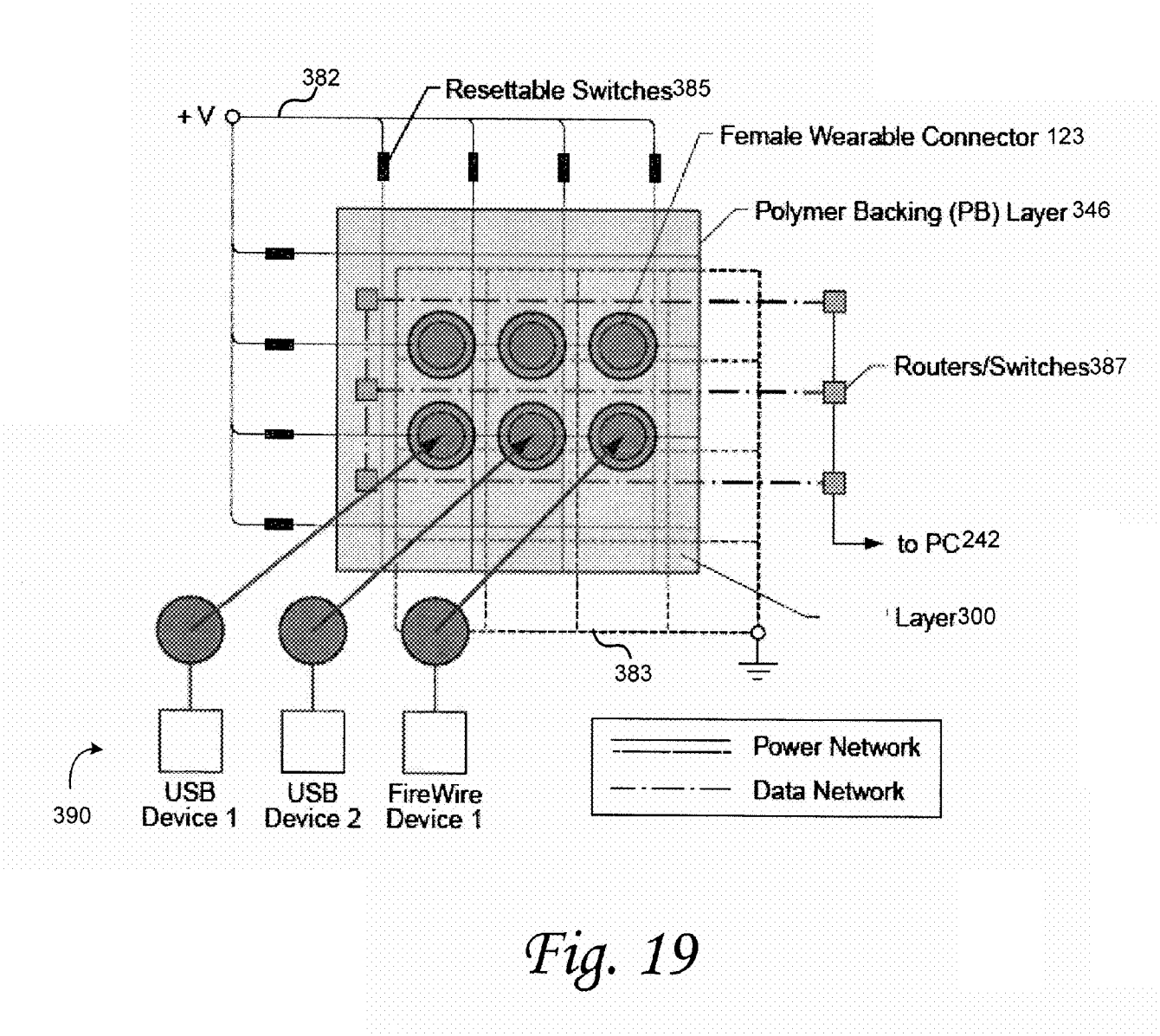
FIG. 19 is a diagram illustrating the attachment of devices and a computing device to a redundant data and power network in accordance with one embodiment of the invention.

FIG. 19 is a diagram illustrating an example of devices 390 as loads connected to a redundant network via connectors 123 and a computing device 242 connected via routers/switches 387 such as, for example, those described above. As this example illustrates, devices 390 can be connected to redundant data and power buses such as for example buses using USB or FireWire standards. This example also illustrates a computing device 242 connected via routers switches 387.

Figure 20:
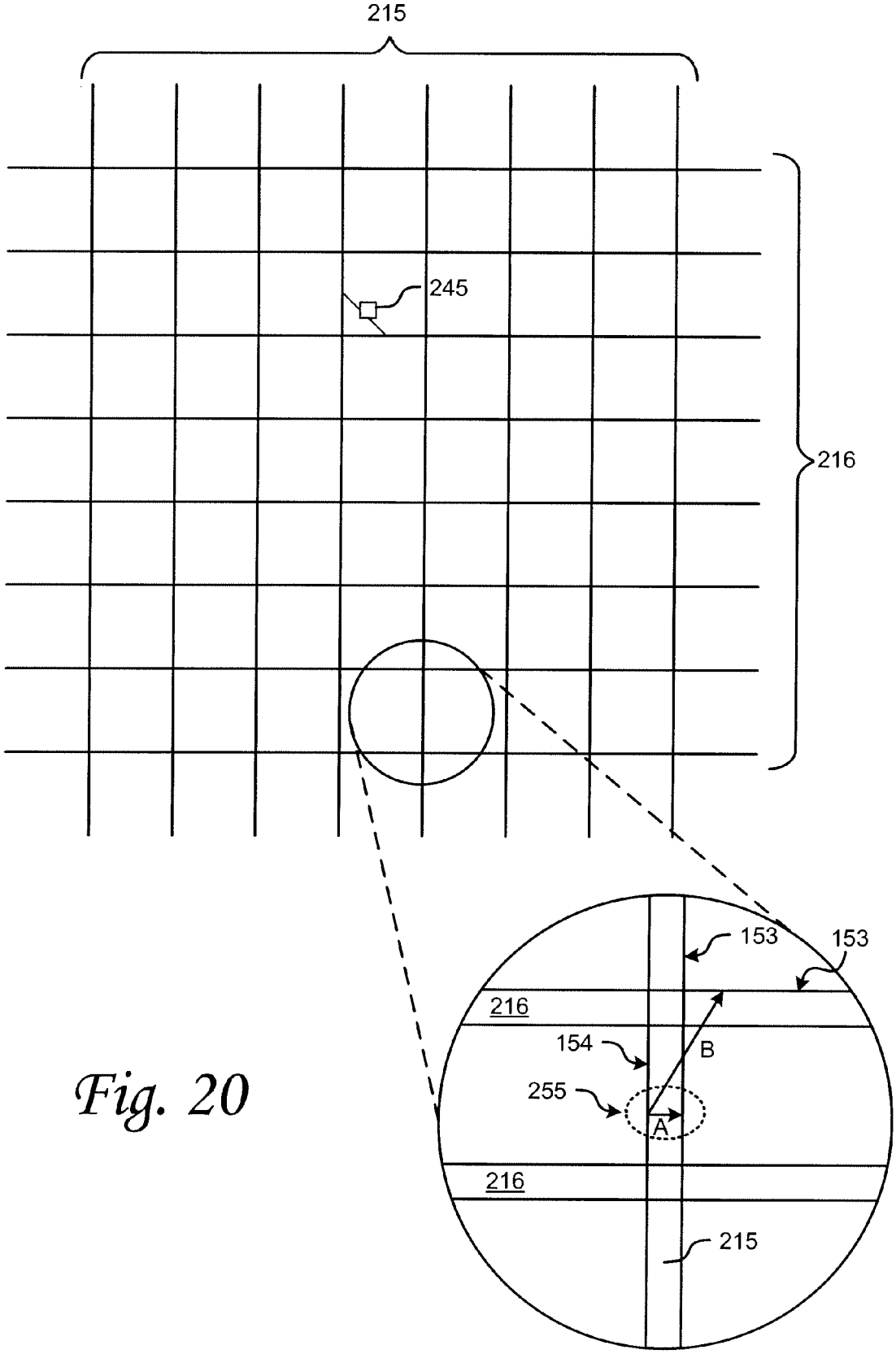
FIG. 20 is a diagram illustrating an example of utilizing self-healing wires for multiple redundant communication paths in accordance with one embodiment of the invention.

FIG. 20 is a diagram illustrating an example of utilizing self-healing wires for multiple redundant communication paths in accordance with one embodiment of the invention. Referring now to FIG. 20, illustrated are eight redundant communication paths 215 configured as a parallel communication paths between two nodes (not illustrated). Also illustrated in FIG. 20 are eight redundant communication paths 216 also configured between two nodes. Loads 245 (only one illustrated) can be connected to paths 215 and 216.

The expanded-view portion of FIG. 20 generally illustrates an embodiment wherein connection paths 215, 216 are implemented utilizing self-healing wires. For ease of illustration, these self-healing wires in this example are shown simply as two lines, one for conductor 153 and one for conductive polymer 154. Accordingly, in such embodiments, if a communication path 215, 216 is broken, the conductive polymer 154 can be utilized to repair the damaged conductor 153, for example, as described above in the various embodiments. For example, as illustrated in the expanded view portion of FIG. 20, assume that damage occurs to a communication path 215 at the area outlined by the dashed ellipse 255. In such a scenario, conductive polymer 154 would flow to conductor 153 to repair damage thereto.

As described above, the viscosity of conductive polymer 154 and its cure time can be chosen such that sufficient quantities of polymer 124 reach the damaged areas of conductor 153 as illustrated by arrow A. However, it might be desirable to have conductive polymer 154 cure in a sufficient amount of time such that it does not travel to conductor 153 of communication path 216 thereby causing an undesirable electrical connection as shown by Arrow B.

In various embodiments, the self-healing conductor and polymer configurations can be configured so as to allow appropriate or desirable flow of the conductive polymer 154 to result in desired healing effects. For example, in one embodiment, the placement of conductive polymer 154 (whether or not used with curing agent 155) can be determined such that gravitational forces will result in the flow of conductive polymer 154 to work toward the damaged conductive element 153. Accordingly, in some embodiments, if the orientation of the self-healing cabling in the application is known or can be fixed or somewhat control, the relative placement of conductive polymer 154 in relation to conductor 153 can be chosen appropriately. In a further embodiment, markings can be provided on insulator or exterior portion of the self-healing cable to allow application or placement of the cabling in a preferred orientation.

As another example, the conductive polymer 154 (as well as curing agent 155 the in embodiments using curing agent 155) can be provided under pressure to facilitate appropriate flow of the conductive polymer 154 upon the occurrence of damage to conductor 153. As a further example, in one embodiment, and additional reservoir of conductive polymer 154 can be provided and can further be enclosed in any elastic pouch for enclosure to provide a pressure on the polymer reservoir. Accordingly, when damage is sustained, this application of pressure induces the polymer to flow to the damaged area. Curing of the polymer to "seal" the damaged area should prevent further flow of the polymer. Accordingly, cure times can be considered in light of anticipated damage and available pressure to ensure sufficient flow while minimizing polymer waste.

As these examples illustrate, in some embodiments, a self-healing conductive element such that it incorporates a plurality of features useful for an electrical garment such as, for example, the physical or mechanical connection of garment portions, electromagnetic connection for one or more electronic devices, heat dissipation or management, and EMI shielding.

In various embodiments, the electrical garment can be configured and designed to combine functionality with aesthetics. For example, the electrical garment "tailor" can be analogized to an architect of a building in that each will strive to integrate functionality and performance into a design that is aesthetically pleasing. For example, attachment points for electronic devices can be chosen in such a way that electrical connections through naturally placed garment seams can be accomplished with few or no additional seams being added merely for the purpose of electrical connection. As another example, attachment points for electronic devices can be chosen in such a way that any seams that might be desirable to add for electrical connection can be added in a place or manner that they are aesthetically pleasing. For example, the devices might be configured to be attached in a way that the seams can be hidden from view or in a way that seams can be added in a decorative manner appearing as, for example, adornment to the garment.

In various embodiments, the electrical garment can be designed partially or completely "from scratch" with the electrical functionality in mind. In other embodiments, existing garments can be retrofitted to include electrical devices and electrical interconnects thereto. For example, attachment points for electrical devices can be added to existing garments and communication media 132 added to existing seams. Additionally, new seams can be added for areas where additional communication media 132 is required. Where communication media 132 is added to existing seams, in some instances depending on the seam configuration, communication media 132 can be threaded or fished through existing seams without having to remove or replace any stitching. In other instances, seam stitching may have to be removed and replaced to allow the integration of communication media 132 in existing seam.

As the above examples illustrate, communication media 132 can be added to existing garment design and additional paths or stitching can be provided as desirable. Various connection points were connection mechanisms can be included with an electrical garment to allow for the integration of electrical devices as appropriate. For example, releasable and non-releasable attachment means can be included for attachment of various electrical devices. As one example, pouches, pockets, or other like structures can be sewn or otherwise integrated into a garment and configured to hold an appropriately sized electrical device. As another example, releasable attachment means such as, for example, snap fasteners, hook-and-loop fasteners, and other fastening means can be used to provide a releasable attachment of electronic devices to the garment. As yet another example, non-releasable attachment means can be used to more permanently affects an electronic device to the garment. For example, an electronic device can be permanently sewed glued or welded into the garment or could be attached by other non-releasable attachment means.

Various configurations of electrical connectors can be utilized to provide an electrical connection between the electrical devices and communication media 132. The electrical devices can be interconnected as desired for a given functionality. Interconnections can be made on a point-to-point basis, as a network, or in a daisy-chained fashion. For example, a "backbone" communication media can be provided for the interconnection of electrical devices. Examples of electrical connectors that can be used can include those described in U.S. Pat. Nos. 7,297,002 and 7,335,067 and Patent Application Publication Nos. US 2007/026695 and WO 2007/015786.

As described in various embodiments herein, a various configurations of self-healing conductors can be used to provide electrical or electromagnetic connectivity between or among a plurality of electrical devices associated with the garment. In a simple embodiment, point-to-point wiring can be used to connect one or more electrical devices directly. While in other embodiments daisy-chains as well as backbone or network topologies can be implemented to provide connection of the one or more electrical devices.

In some embodiments, the self-healing conductor can be integrated with a garment in a manner so as to provide for flexible adaptability to a plurality of configurations of electrical devices allowing for a broad range of environments or applications. In other embodiments, a more custom approach can be taken to predefine the communication paths for a particular application or set of applications or for particular types or classes of devices. As one example, a garment might be created as a garment that has self-healing conductors integrated at least partially within existing stitching (for example, the seams) so as to allow interconnectivity among a predefined set of devices or device types. As a further example, a garment might be created as a wearable computer that has self-healing conductors integrated to allow interconnectivity among computing devices and peripherals. Carrying this example further, self-healing conductors might be integrated so as to allow the garment to usably house a central processing unit, I/O devices and peripherals. Such communication media 132 can be laid out to allow these components to operate together as a wearable computing system. As this example serves to illustrate, the electrical garment can be preconfigured for a desired application and can be configured with some or all of the electrical devices pre-integrated into the garment or can be configured so as to allow for plug-and-play connectivity of electrical devices.

In some embodiments, relatively small form factor self-healing conductors can be used such that they do not appear bulky or bulging from an outward appearance and so that they do not present an uncomfortable profile to the wearer. It should be noted that the use of the term "electromagnetic" herein is used as shorthand and intended to cover not only signals in the conventionally described electromagnetic spectrum (3 Hz and above) but also electrical communication paths below 3 Hz including, for example, DC or non-time-varying signals.

While various embodiments of the present invention have been described above, it should be understood that they have been presented by way of example only, and not of limitation.

Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof: the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A self-healing conductor, comprising:

an electrical conductor;

an uncured electrically conductive viscous material disposed adjacent the electrical conductor; and an enclosure at least partially enclosing the electrically conductive viscous material.

2. The self-healing conductor of claim 1, wherein the electrical conductor is comprised of a conducting material.

3. The self-healing conductor of claim 1, wherein the electrical conductor is comprised of a semi-conducting material.

4. The self-healing conductor of claim 1, wherein the uncured electrically conductive viscous material is a self-curing conductive polymer.

5. The self-healing electrical conductor of claim 1, wherein the self-curing conductive polymer increases in viscosity upon exposure to air.

6. The self-healing conductor of claim 1, further comprising a curing agent and wherein the electrical conductor, conductive polymer, and curing agent are adjacent to one another but not concentric.

7. The self-healing electrical conductor of claim 1, wherein the electrical conductor, electrically conductive viscous material, and curing agent are disposed in at least one channel adjacent to the electrical conductor.

8. The self-healing electrical conductor of claim 1, wherein a viscosity of the uncured electrically conductive viscous material is selected based on a distance between the electrically conductive viscous material and the electrical conductor.

9. The self-healing electrical conductor of claim 1, wherein the uncured electrically conductive viscous material comprises carbon nanotubes.

10. A self-healing conductor, comprising:

an electrical conductor;

an uncured electrically conductive viscous material adjacent the electrical conductor;

a curing agent adjacent to but separated from the electrically conductive viscous material a first enclosure at least partially enclosing the uncured viscous electrically conductive material; and a second enclosure at least partially enclosing the curing agent.

11. The self-healing conductor of claim 10, wherein the electrical conductor is ring-shaped.

12. The self-healing conductor of claim 11, wherein the conductive polymer and curing agent are disposed within the ring-shaped conductor.

13. The self-healing conductor of claim 11, wherein the curing agent is disposed within the ring conductor and the conductive polymer is contained within containers distributed within the curing agent.

14. The self-healing conductor of claim 10, wherein the conductive polymer is disposed in the center of the ring-shaped conductor.

15. The self-healing conductor of claim 10, wherein the conductive polymer is contained in containers distributed within the curing agent.

16. The self-healing conductor of claim 10, wherein the conductive polymer is ring-shaped.

17. The self-healing conductor of claim 16, wherein the ring-shaped conductive polymer contains containers of the curing agent.

18. The self-healing conductor of claim 10, wherein the electrical conductor, uncured electrically conductive viscous material, and curing agent are adjacent to one another but not concentric.

19. The self-healing electrical conductor of claim 10, wherein the uncured electrically conductive viscous material, and curing agent are disposed in at least one channel formed by the first and second enclosures and adjacent to the electrical conductor.

20. A multi-layer self-healing electrical conductor, comprising an electrical conductor;

an electrically conductive viscous material disposed adjacent the electrical conductor; and an enclosure at least partially enclosing the electrically conductive viscous material; and wherein the electrical conductor is disposed in a first layer of the multi-layer conductor; and the electrically conductive viscous material is disposed in a second layer adjacent the first layer containing the electrical conductor; wherein the second layer comprises an insulator at least partially enclosing the viscous electrically conductive material.

21. The self-healing electrical conductor of claim 20, further comprising an insulating layer disposed between the first and second layers.

22. The self-healing electrical conductor of claim 20, wherein the first and second layers are positioned such that a cut or break in the first and second layers severing the electrical conductor and severing the enclosure at least partially enclosing the electrically conductive viscous material allows the electrically conductive viscous material to flow to the first layer and cure, thereby providing a conductive path in the electrical conductor bridging the cut or break.

23. The self-healing electrical conductor of claim 20, further comprising a curing agent layer disposed in a third layer adjacent the second layer containing the electrically conductive viscous material.

24. The self-healing electrical conductor of claim 23, further comprising a barrier layer disposed between the second and third layers.

25. The self-healing electrical conductor of claim 20, wherein the enclosure comprises a plurality of discrete wells and the electrically conductive viscous material is disposed in the wells.

26. The self-healing electrical conductor of claim 20, further comprising a curing agent layer disposed in a third layer adjacent the second layer containing the electrically conductive viscous material; wherein the second layer comprises a plurality of discrete first wells and the electrically conductive viscous material is disposed in the first wells; and wherein the third layer comprises a plurality of discrete second wells and the curing agent is disposed in the second wells.

27. The self-healing electrical conductor of claim 26, further comprising a barrier layer between corresponding ones of the first and second wells and wherein the first and second wells are positioned with respect to the electrical conductor such that a cut or break in the first, second and third layers and the barrier layer allows the electrically conductive viscous material to mix with the curing agent and flow to the first layer and cure, thereby providing a conductive path in the electrical conductor bridging the cut or break.

28. A multi-layer self-healing electrical conductor, comprising:

an electrical conductor;

an electrically conductive viscous material adjacent the electrical conductor;

a curing agent adjacent to but separated from the electrically conductive viscous material a first enclosure at least partially enclosing the viscous electrically conductive material; and a second enclosure at least partially enclosing the curing agent; and wherein the electrical conductor is disposed in a first layer of the multi-layer conductor; the electrically conductive viscous material is disposed in a second layer adjacent the first layer containing the electrical conductor; the curing agent is disposed in a third layer adjacent to the second layer; and wherein the self-healing electrical conductor further comprises a barrier layer between the second and third layers.

29. The self-healing electrical conductor of claim 28, further comprising an insulating layer disposed between the first and second layers.

30. The self-healing electrical conductor of claim 28, wherein the first and second layers are positioned such that a cut or break in the first, second, third and barrier layers, severing the electrical conductor and releasing the electrically conductive viscous material and curing agent, allows the electrically conductive viscous material to flow to the first layer and cure, thereby providing a conductive path in the electrical conductor bridging the cut or break.

31. The self-healing electrical conductor of claim 28, further comprising a barrier layer disposed between the second and third layers.

32. The self-healing electrical conductor of claim 28, wherein the first and second enclosures comprise a first and second plurality of discrete wells.

33. The self-healing electrical conductor of claim 32, further comprising a barrier layer between corresponding wells of the first and second pluralities of wells and wherein the wells are positioned with respect to the electrical conductor such that a cut or break in the first, second and third layers and the barrier layer allows the electrically conductive viscous material to mix with the curing agent and flow to the first layer and cure, thereby providing a conductive path in the electrical conductor bridging the cut or break.

* * * * *